United States Patent [19]

Erickson

[11] 4,325,331

[45] Apr. 20, 1982

[54] DUAL-EXPANSION INTERNAL COMBUSTION CYCLE AND ENGINE

[76] Inventor: Frederick L. Erickson, 2610 Bosworth Dr., Fort Wayne, Ind. 46805

[21] Appl. No.: 180,135

[22] Filed: Aug. 21, 1980

Related U.S. Application Data

[63] Continuation-in-part of Ser. No. 959,795, Nov. 13, 1978, abandoned.

[51] Int. Cl.[3] ..... F02B 59/00

[52] U.S. Cl. ..... 123/42; 123/45 R; 123/47 R; 123/50 R; 123/53 R; 123/61 R; 123/63

[58] Field of Search ..... 123/42, 45, 47, 50, 123/51, 53, 58, 61, 63, 65, 197, DIG. 4; 92/2, 52, 62; 91/167, 173

[56] References Cited

U.S. PATENT DOCUMENTS

| | | | |
|---|---|---|---|
| 1,219,512 | 3/1917 | Weiss | 123/65 A |
| 2,280,487 | 4/1942 | Heylandt | 60/622 |
| 3,630,178 | 12/1971 | Erickson | 123/53 B |
| 4,157,080 | 6/1979 | Hill | 123/53 B |

*Primary Examiner*—Craig R. Feinberg

[57] ABSTRACT

A novel internal combustion cycle and internal combustion engine operating thereon. Expansion of the hot combustion gases is controllably achieved in a primary combustion/expansion chamber and a secondary expansion chamber in a manner to reduce engine exhaust pressures to essentially atmospheric or below. The chambers are defined by two members movable with respect to each other within an engine block volume. Porting and fluid flow control is accomplished through the motion of the moving members. Embodiments include the use of a suction chamber which achieves subatmospheric exhaust pressures and which, in conjunction with a pressure-pumping chamber, achieves a "push-pull" effect on the fluid in the engine. Unique porting of the fuel/air mixture is provided and it includes, if desired, means to vary the fuel/air ratio during the cycle. The engine of this invention exhibits performance characteristics associated with the usual four-stroke cycle engines.

8 Claims, 66 Drawing Figures

TOP DEAD CENTER;
RESIDUAL COMBUSTION GASES
EXHAUSTING TO ATMOSPHERE

BEGINNING OF
SECONDARY
EXPANSION

BOTTOM DEAD CENTER;
INDUCTION BEGINS AND
TRANSFER OF COMBUSTION
GASES TO SECONDARY
CHAMBER CONTINUES

FUEL/AIR INDUCTION;
TRANSFER OF COMBUSTION
GASES TO SECONDARY
CHAMBER CONTINUES

FUEL/AIR INDUCTION PORT FULL OPEN AND TRANSFER OF COMBUSTION GASES TO SECONDARY CHAMBER CONTINUES

INDUCTION PORT CLOSING AND EXHAUST PORT OPENING

EXHAUSTING CONTINUES (CIRCLED NUMERALS REFER TO FIGURES SHOWING APPROXIMATE POSITIONS OF ENGINE COMPONENTS AT POINTS IN CYCLE.)

COMPARISON OF FUNCTIONING OF PISTON ENGINE CYCLES

DUAL-EXPANSION INTERNAL COMBUSTION CYCLE AND ENGINE

This application is a continuation-in-part of my application Ser. No. 959,795 filed Nov. 13, 1978 now abandoned.

This invention relates to a novel internal combustion power cycle and to internal combustion engines operating on the cycle. More particularly, this invention relates to an internal combustion cycle and engine which exhibit the performance characteristics of a four-stroke cycle engine while retaining the advantages of simplicity normally associated with the two-stroke cycle engine.

The standard two-stroke internal combustion piston engine is generally used to power hand-held tools such as chain saws and other devices where a relatively high power-to-weight ratio is desired. Such two-stroke engines are not fuel efficient; and they develop a relatively high level of noise and hydrocarbon pollution. Although mufflers may be used to lower the noise level of these engines, they add to their weight, thus merely substituting one cause of operator discomfort and fatique for another.

Although the four-stroke internal combustion piston engines exhibit relatively high fuel efficiency, they are generally expensive to manufacture because of the necessity for complex valve mechanisms. Moreover, they are too heavy and bulky for those applications requiring a high power-to-weight ratio. Therefore, they are limited to such uses as power lawn mowers, snow blowers and the like. The four-stroke piston engines possess high vibration levels, especially in one and two-cylinder configurations. This disadvantage tends to make it uncomfortable for operators in close contact with the engines in operation. Although the exhaust noise level of the four-stroke engines is not as high or irritating as a two-stroke cycle engine, they still must incorporate adequate muffler means to reduce exhaust noises to acceptable levels.

Wankel engines inherently do not exhibit high fuel efficiencies, due in part to fuel mixture blowby occurring as the apex seal clearance gap opens to its widest spacing as the rotor apex seal sweeps through the hot high-pressure combustion chamber quadrant where the housing is the hottest and widest due to heat expansion. The high fuel consumption of Wankel engines is thus partly due to the expansion of nonsymmetrical components which causes the apex seals to leak excessively when traveling through the high-pressure, hot, expanded quadrant of the housing. Moreover, the manufacturing cost of Wankel engines is relatively high because of the necessity to attain the complex curvature of the internal housing. Although the Wankel engine is free of any appreciable vibration, it is difficult to achieve complete balance and some vibration is evident in operation. Wankel engines do, however, require adequate muffler means to silence the high-pressure exhaust blow-down noise.

In my U.S. Pat. No. 3,630,178 I have disclosed a novel four-stroke internal combustion engine in which an orbiting piston, with its center connected to a crankshaft, revolves in a circular or orbital path. As the piston travels through its orbital path it slides back and forth inside a combustion chamber member causing it to reciprocate in a direction substantially perpendicular to the path of the orbiting piston. These combustion chambers are separated by the orbiting piston which causes them to alternately accomplish a compression and expansion stroke. The dual-stage, combustion/expansion engine of U.S. Pat. No. 3,630,178 operates only on a four-stroke cycle and hence it is much more complex than the engine of this invention.

In contrast to the engine disclosed in my earlier patent, the engine of this invention operates on a dual-expansion cycle attaining a combination of the advantages associated with both two-stroke and four-stroke cycles while not being subject to their major disadvantages.

It is therefore a primary object of this invention to provide a novel and improved thermodynamic cycle for an internal combustion engine. It is another object to provide a thermodynamic cycle of the character described which achieves higher fuel efficiencies, operates more quietly at cooler temperatures and creates less pollution than the cycles associated with internal combustion engines presently in general use.

Another primary object of this invention is to provide an improved internal combustion engine. A further object is to provide an internal combustion engine of the character described which exhibits significant performance improvement in terms of higher power-to-fuel consumption ratios over presently used comparably sized internal combustion engines. Still another object is to provide a unique internal combustion engine in which exhaust blowdown is virtually eliminated and for which there is no need for a muffler; in which complete dynamic balance is attainable; and for which the level of exhaust pollutants is low. An additional object is to provide an engine of the character described which is further characterized by its ability to operate on gasoline using glow plugs; which is capable of longer operating life; which is lighter in weight than present internal combustion engines of equivalent horsepower; and which produces exhaust gases of relatively low temperature, thus making the engine particularly suitable for handheld tools such as chain saws and the like.

Yet a further object of this invention is to provide an internal combustion engine which operates on a unique cycle, incorporates a unique porting system and possesses the ability to operate at high speeds for extended periods of time.

Other objects of the invention will in part be obvious and will in part be apparent hereinafter.

The invention accordingly comprises the several steps and the relation of one or more of such steps with respect to each of the others, and the apparatus embodying features of construction, combinations of elements and arrangement of parts which are adapted to effect such steps, all as exemplified in the following detailed disclosure, and the scope of the invention will be indicated in the claims.

According to one aspect of this invention there is provided a method of developing power mechanically through the combustion of a combustible fluid, comprising the steps of providing a source of a combustible fluid; providing a primary combustion/expansion chamber of controllable variable volume and a secondary expansion chamber of controllable variable volume in controllable fluid communication with the primary chamber; compressing within the primary chamber a predetermined amount of the combustible fluid by reducing the volume thereof to a minimum and igniting the combustible fluid as the volume approaches minimum, and simultaneously forcing combustion gases to exhaust from the secondary chamber by reducing the volume thereof while maintaining the primary and secondary chambers isolated from each other; increasing the volume of the primary chamber to provide combustion gases under pressure and simultaneously reducing the volume of the secondary chamber to its minimum while the chambers remain isolated from each other; preliminarily expanding the combustion gases in the primary chamber by increasing its volume; continuing expanding the combustion gases in the primary chamber and increasing its volume, and simultaneously transferring the combustion gases into the secondary chamber and increasing its volume whereby there is provided a total expansion volume greater than the maximum volume of the primary chamber to give rise to a fluid pressure within the chambers at or below ambient pressure; continuing transferring the combustion gases into the expanding secondary chamber and simultaneously admitting the combustible fluid into the primary chamber thereby beginning the scavenging of the combustion gases from the primary chamber; decreasing the volume of the primary chamber while continuing the transferring and scavenging of the combustion gases and simultaneously increasing the volume of the secondary chamber; continuing decreasing the volume of the primary chamber thereby beginning the compressing of the combustible fluid while simultaneously admitting the combustible fluid into the primary chamber thereby beginning the scavenging of the combustion gases from the primary chamber; decreasing the volume of the primary chamber while continuing the transferring and scavenging of the combustion gases and simultaneously increasing the volume of the secondary chamber; continuing decreasing the volume of the primary chamber thereby beginning the compressing of the combustible fluid while simultaneously decreasing the volume of the secondary chamber and exhausting the combustion gases therefrom at approximately ambient pressure while maintaining the primary and secondary chambers isolated from each other, thereby providing the conditions required to repeat the cycle; and employing the expansion of the combustion gases to deliver work.

According to another aspect of this invention there is provided an internal combustion engine, comprising in combination a central power block defining between forward and after end plates a fluid-tight engine volume; a main crankshaft arranged to deliver mechanical power; first chamber defining means movable within the engine volume to define opposed second and fourth chambers of variable and complementary volumes; second chamber defining means movable within the first chamber defining means to define opposed first and third chambers of variable and complementary volumes, the second chamber defining means being connected to the main crankshaft and providing in its motion the motion of the first chamber defining means; first porting means providing fluid communication between the first and second chambers, the flow of fluid through the first porting means being controlled by the movement of the second chamber defining means; second porting means providing fluid communication between the second chamber and the atmosphere, the flow of fluid through the second porting means controlled at least in part by the movement of the second chamber defining means; fuel/air mixture supply means to provide a fuel/air mixture to the first chamber; induction porting means to control the flow of the fuel/air mixture from the supply means into the first chamber, the induction porting means having a configuration and location in the after engine plate such that it is opened by the motion of the first chamber defining means and closed by the motion of the second chamber defining means; and ignition means arranged to ignite said fuel/air mixture in the first chamber.

According to yet another aspect of this invention there is provided an internal combustion engine, comprising in combination a central power block including parallel side walls and opposing end walls defining between forward and after end plates a fluid-tight engine volume; a main crankshaft arranged to deliver mechanical power; a moving combustion chamber member reciprocatable within said engine volume to define opposed second and fourth chambers of variable and complementary volumes; an orbiting piston reciprocally movable within the moving combustion chamber member mounted on a piston shaft affixed to and having an axis parallel with and spaced from the main crankshaft, the orbiting piston in its motion imparting reciprocating motion to said moving combustion chamber member and defining opposed first and third chambers of variable and complementary volumes; first porting means providing controllable fluid communication between the first and second chambers, the flow of fluid through the first porting means being controlled by the reciprocal movement of the orbiting piston within the combustion chamber member; second porting means providing controllable fluid communication between the second chamber and the atmosphere, the flow of fluid through the second porting means being controlled at least in part by the reciprocal movement of the orbiting piston; fuel/air mixture supply means to provide a fuel/air mixture to the first chamber; induction porting means to control the flow of the fuel/air mixture from the supply means into the first chamber, the induction porting means having a configuration and location in the after engine plate such that it is opened by the motion of the combustion chamber member and closed by the motion of the orbiting piston; and ignition means arranged to ignite the fuel/air mixture in the first chamber.

According to a further aspect of this invention there is provided an internal combustion engine comprising, in combination, power drive shaft means; a source of a combustible fluid; a first variable-volume, positive displacement chamber; a second variable-volume, positive displacement chamber; combustible fluid supply means arranged to supply a predetermined amount of the combustible fluid to the first chamber for compression, ignition and expansion thereby to supply power to the power drive shaft means; first valve means arranged to controllably couple the first chamber to the second chamber and to open during the expansion of combustion gases resulting from the ignition to allow power-supplying expansion to occur in both the first and said second chambers with continuing expansion in both the first and second chambers until the pressure therein drops to essentially atmospheric; second valve means to controllably couple the first chamber with the source of the combustible fluid, through the combustible fluid supply means, arranged to open at essentially the same time the pressure within the interconnected first and second chambers has reached essentially atmospheric and to remain open at least so long as the sum of the volumes of the first and second chambers increases to effect a suction action causing the combustion gases to be transferred to the second chamber as the combustible fluid is inducted into the first chamber.

The internal combustion engine of this invention is further characterized in that the first chamber is a primary combustion/expansion chamber; the second chamber is a secondary expansion chamber; the first porting means is arranged to provide fluid communication between the first and second chambers as the second chamber is increasing in volume; and the second porting means is arranged to provide fluid communication between the second chamber and the atmosphere when said second chamber is decreasing in volume.

For a fuller understanding of the nature and objects of this invention, reference should be had to the following detailed description taken in connection with the accompanying drawings in which FIGS. 1–7 diagrammatically illustrate the cycle of this invention, showing in particular the porting and the role of the secondary expansion of the combustion gases prior to their exhaustion;

FIG. 8 further illustrates this cycle as it is applied to one embodiment of the apparatus of this invention;

FIG. 9 presents PV diagrams for a conventional internal combustion engine and for the cycle of this invention;

Figure 62:
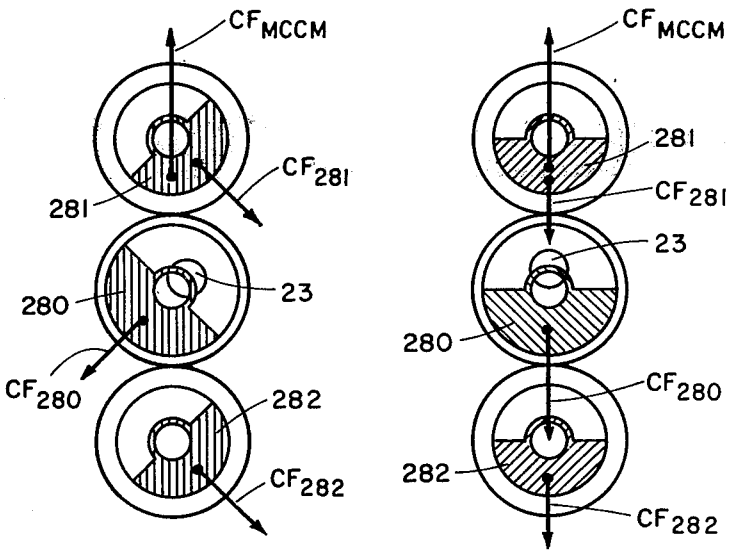
Figure 62:
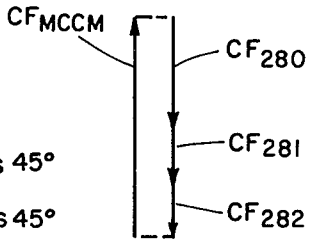
Figure 61:
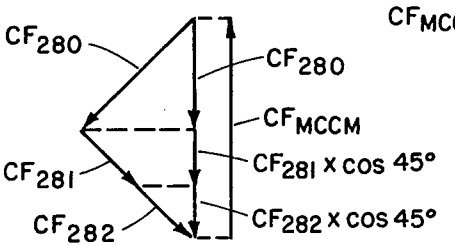
Figure 63:
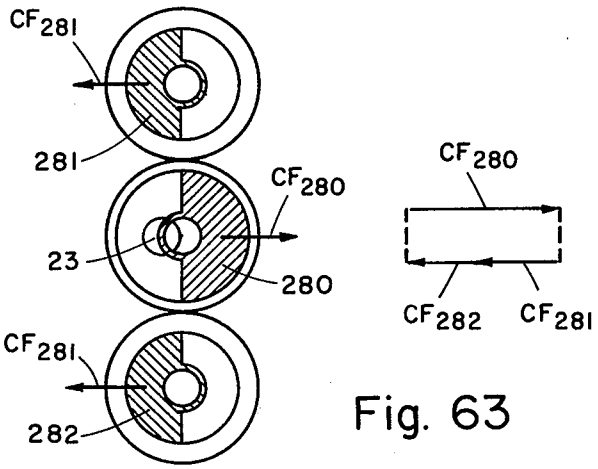
Figure 60:
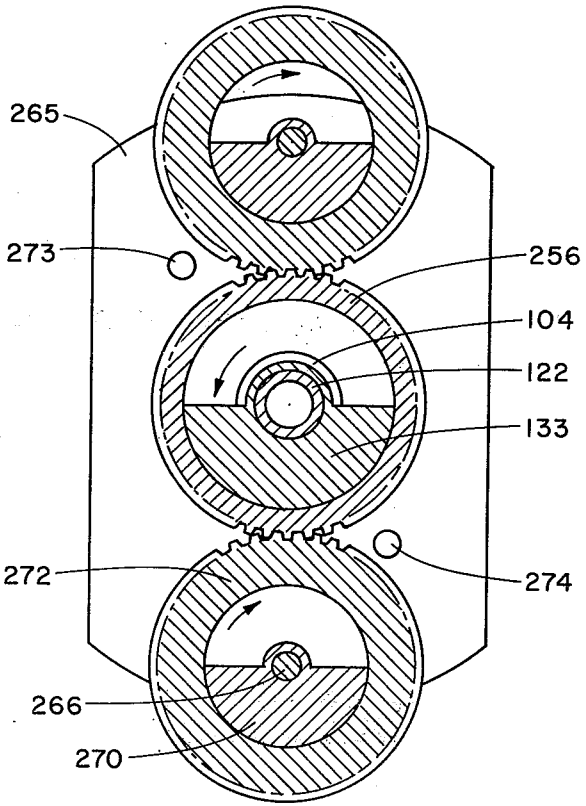
FIGS. 59 and 60 are cross sectional and after elevational views of an engine constructed in accordance with this engine and incorporating supplemental counterweights to completely balance the inertial forces of the moving combustion chamber member.
Figure 59:
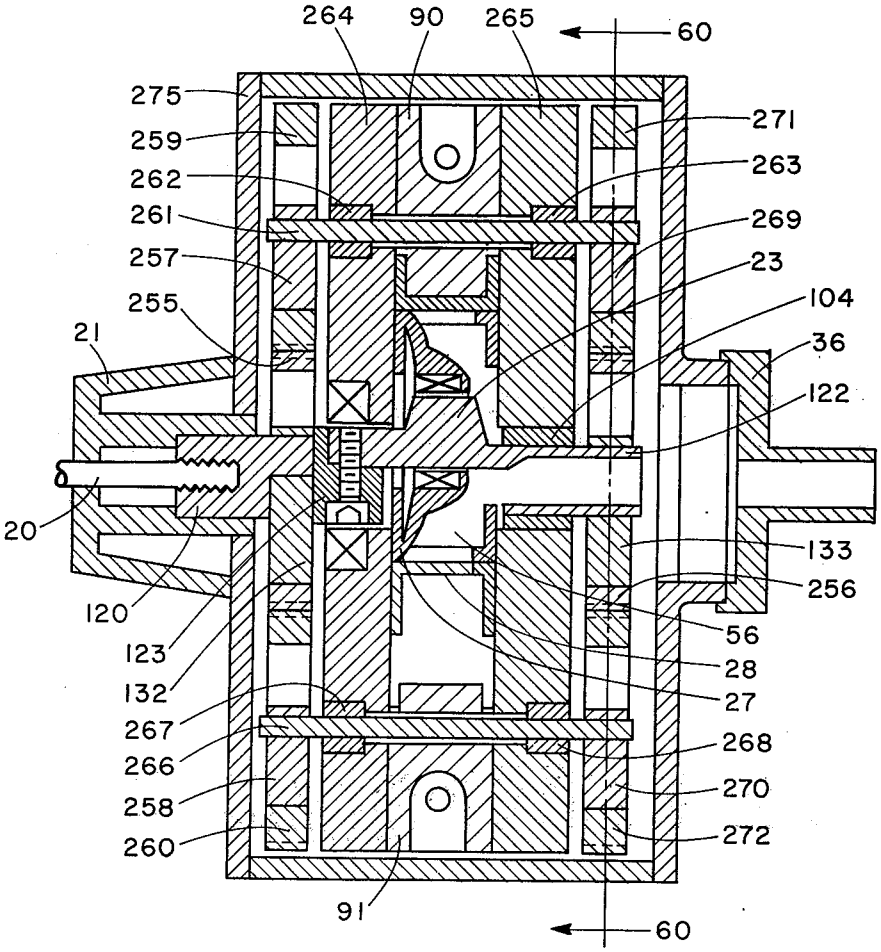
Figure 66:
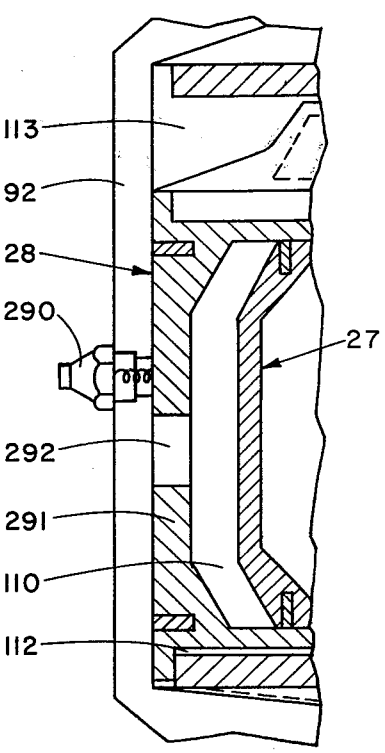
Figure 65:
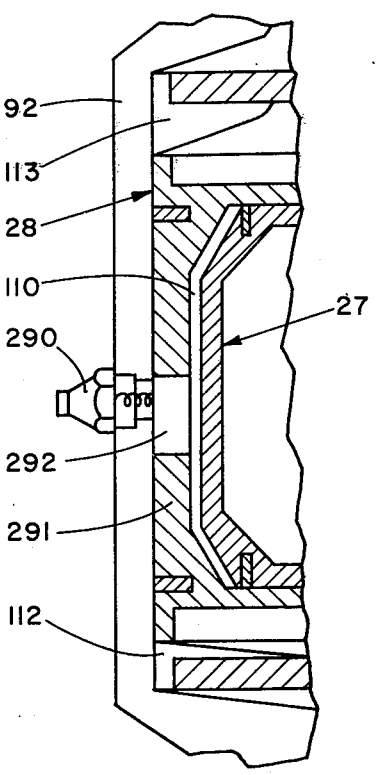
Figure 64:
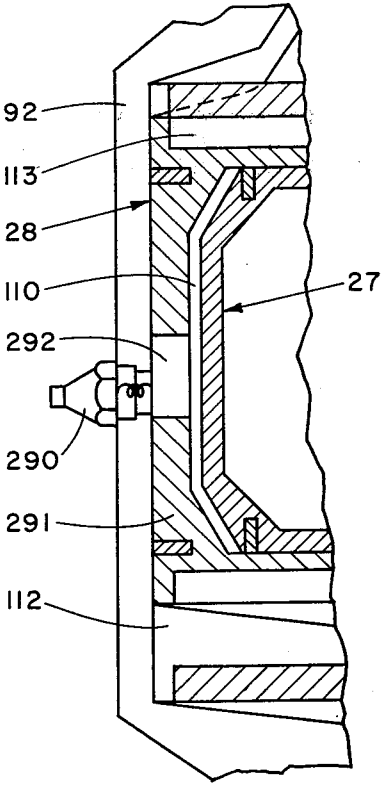

FIGS. 61–63 diagrammatically illustrate the functioning of the supplemental counterweights of the engine embodiment of FIGS. 59 and 60; and FIGS. 64–66 illustrate the incorporation of ignition exposure control means which make it possible to use simple ignition means such as glow plugs.

FIGS. 1–7 illustrate diagrammatically, without reference to a specific apparatus embodiment, the unique thermodynamic cycle of this invention.

Figure 8:
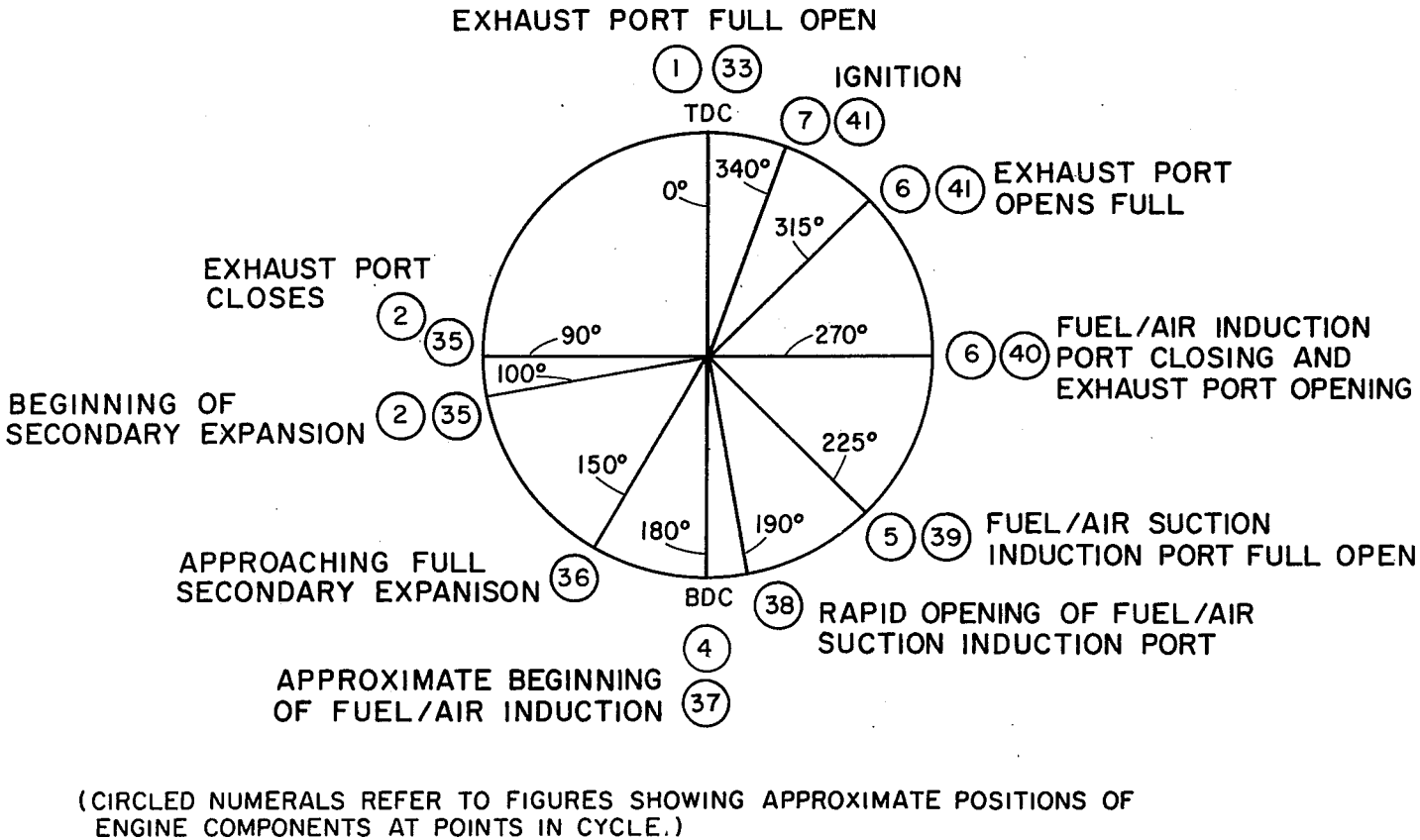
Figure 9:
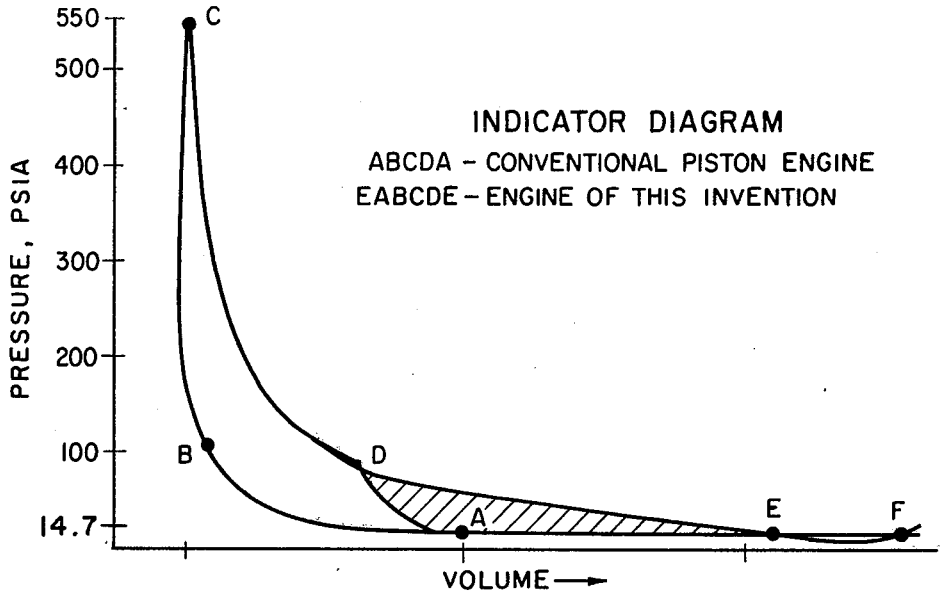

However, to present this cycle in a more realistic setting, FIGS. 8 and 9 are included, FIG. 8 to illustrate the cycle in terms of relative crank angles such as would be done for a reciprocating piston, and FIG. 9 to show a PV diagram for a conventional piston engine and one operating on the cycle of this invention. The numbered positions in FIG. 8 correspond to the figure numbers of FIGS. 1–7 and to FIGS. 32–41. Exemplary apparatus for achieving the cycle will be described with reference to FIGS. 10–29.

As will be seen in FIGS. 1–7 there are provided a primary combustion/expansion chamber 10 and a secondary expansion chamber 11 which are in fluid communcation during predetermined cycle intervals through an interchamber port 12, the cross hatching of which is used in these FIGS. 1–7 to indicate when it is closed or partially closed. Associated with primary combustion/expansion chamber 10 is a fuel/air induction port 13 and with secondary expansion chamber 11 an exhaust port 14; cross hatching being used to indicate when these ports are closed or partially closed. The volumes of chambers 10 and 11 are variable as conveniently shown by the use of cross hatching to indicate those portions of the chambers unoccupied by gases. The use of pistons which are responsive to the varying pressures within the chambers may be cited as means to vary the volumes. Combustion/expansion chamber 10 has means 15, e.g., a spark plug, to ignite a compressed fuel/air mixture at a predetermined time during the cycle.

Figure 1:
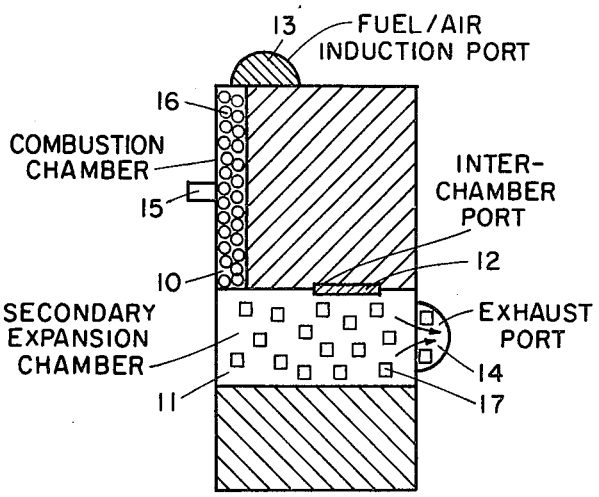
Figure 2:
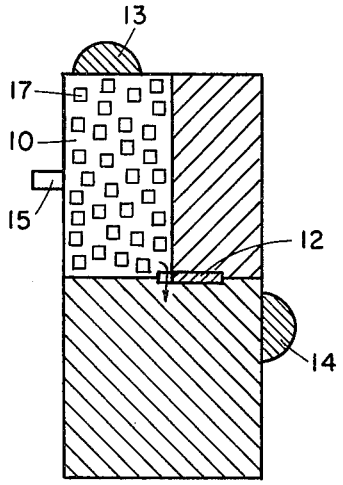
Figure 3:
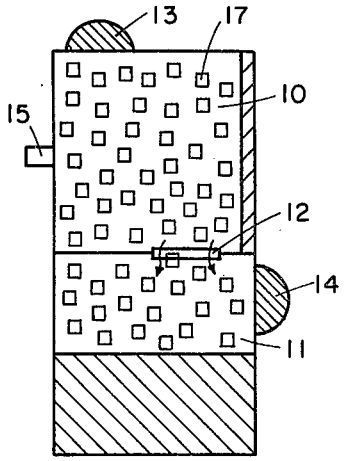
Figure 4:
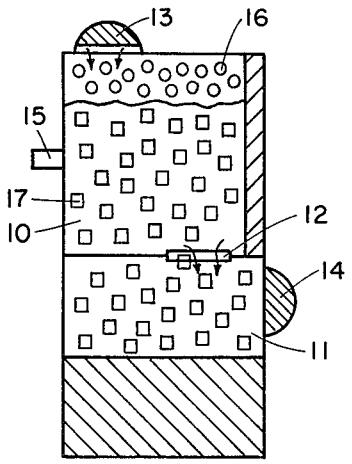
Figure 5:
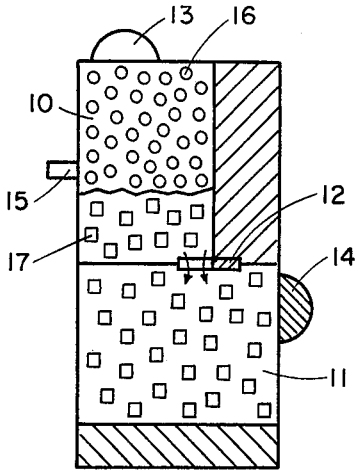
Figure 6:
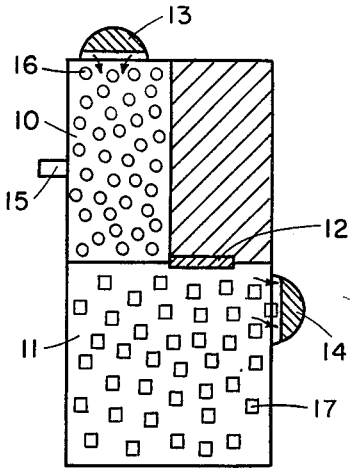
Figure 7:
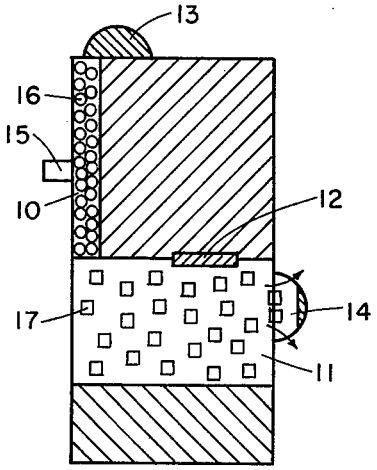

As presented in FIGS. 1–7, the cycle beings when the primary combustion/expansion chamber is at minimum volume and contains a combustible fuel/air mixture, represented in these diagrams as small circles 16. This is, of course, the equivalent of top dead center in a conventional piston engine. Such terms as top and bottom dead center, and the like, will hereinafter be applied to the detailed description of the cycle and apparatus of this invention since they carry with them essentially the same well-established connotations as for conventional piston engines. At the beginning of the cycle (FIG. 1) interchamber port 12 is closed and exhaust port 14 is open to allow the residual exhaust gases, represented as small squares 17, to exhaust to the atmosphere. Subsequent to the attainment of minumum volume in chamber 10, i.e., top dead center, the fuel/air mixture is ignited, giving rise to hot combustion gases which expand first within primary chamber 10 and then into secondary expansion chamber 11 which has attained minimum volume and from which the exhausting of gases is prevented through closure of port 14 (FIG. 2). Expansion of the combustion gases within both chambers 10 and 11 continues while both ports 13 and 14 remain closed (FIG. 3) until chamber 10 reaches the equivalent of bottom dead center. Through the use of the two chambers for expansion and by the controlled fluid communication between them through port 12, it is possible to provide an expansion volume which is larger, preferably at least about two times larger, than the compression volume. As the combustion gases continue to expand into secondary expansion chamber 11 the fluid pressure within the system is reduced to ambient or slightly below ambient (FIG. 9). At this point in the cycle, induction port 13 is opened to rapidly pull in the next fuel/air charge (FIG. 4), which begins an effective scavenging of residual combustion gases from chamber 10. Because the reduced fluid pressure within the system develops a suction action, it is possible to transfer essentially all of the combustion gases into secondary expansion chamber 11 before interchamber port 12 is closed and chamber 11 reaches maximum volume (FIG. 5). Then with the isolation of secondary expansion chamber 11, exhaust port 14 is rapidly opened to discharge the combustion gases, which are at ambient pressure or slightly below, into the atmosphere (FIG. 6). The exhausting of gases continues as the charge of fuel/air mixture is compressed (FIG. 7) to reach the conditions in both chamber which allow the cycle to begin again.

The effect on the efficiency of this thermodynamic cycle of providing the secondary expansion chamber 11 and of controlling the transfer of combustion gases into this chamber through the regulation of interchamber port 12 is shown in the P-V diagram of FIG. 9. In this diagram, points E and D represent the end of the power output from the cycle of this invention and from a conventional piston engine, respectively. Point F designates the point at which the exhaust port 14 opens (FIG. 6). It is immediately apparent that by being able to begin exhausting the gases only when they have reached essentially atmospheric pressure or below an additional amount of work (represented by the cross hatched area DEA) can be extracted. Moreover, since the gases are exhausted at essentially atmospheric pressure the gas discharge noise normally associated with conventional internal combustion engines is materially reduced and the exhaust gases are much lower in temperature. These operational characteristics make it possible to eliminate the usual muffler and make the engine of this invention particularly attractive for powering handheld tools such as chain saws and powered household equipment such as lawn mowers and snow blowers.

FIGS. 10–29 illustrate in detail one preferred embodiment of the internal combustion engine of this invention. As will be shown, this embodiment is designed as a dual-expansion engine using what may be termed "suction induction" of the fuel/air mixture. An orbiting piston operating within a reciprocating combustion chamber member provides the means to define two opposing primary combustion/expansion chambers and two opposing secondary expansion chambers.

Figure 10:
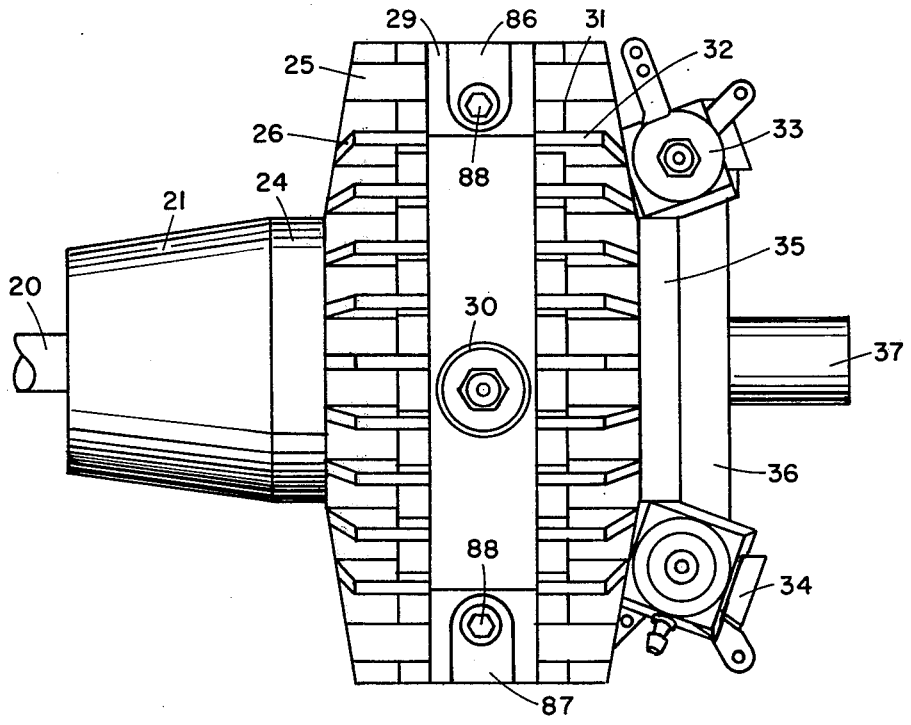
FIG. 10 is a side elevational view of one embodiment of an engine constructed in accordance with this invention.
Figure 11:
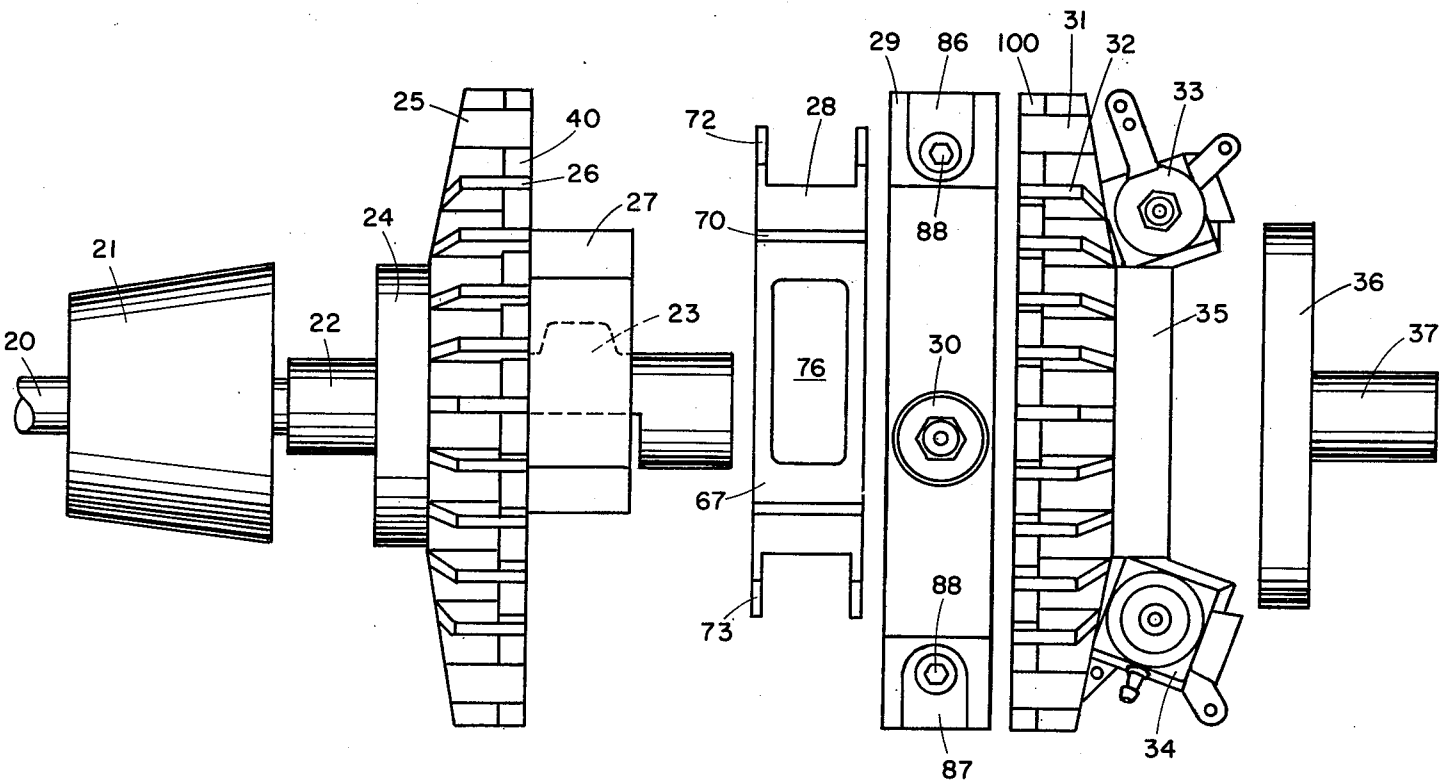
FIG. 11 is an exploded view of the engine of FIG. 10 showing the principal components prior to assembly.

FIG. 10 is a side elevation of this engine and FIG. 11, in which the same reference numbers are used to refer to the same components, shows an exploded view of the main parts of the engine prior to assembly. The power takeoff shaft 20 is connected within the shaft housing 21 to the engine crankshaft 22 which in turn has affixed thereto the orbiting piston shaft 23 (detailed below in FIG. 29). Shaft housing 21 joins bearing housing 24 which is part of the forward engine block 25 having cooling fins 26. The orbiting piston 27 is mounted on piston shaft 23 and is sized to reciprocate back and forth within a combustion chamber member 28 which reciprocates up and down within central power block 29. Opposing spark plugs 30 (only one of which is shown in FIGS. 10 and 11) are mounted in the side walls of central power block 29. An after engine block 31, having cooling fins 32, has mounted thereon opposing carburetors 33 and 34 which communicate through ports (FIG. 24) in engine block 31 with the primary combustion chambers described below. It will be appreciated that carburetors 33 and 34 are exemplary of a suitable means for supplying a predetermined amount of a combustible fluid to the combustion chamber. Integral with after engine block 31 is a bearing housing 35; and affixed to this is an exhaust plate 36 terminating in an exhaust line 37. In the description of this engine the relative positions of the engine components will for convenience be described as forward and after, up and down, sideways, etc., in accordance with the drawings presented. It will, of course, be appreciated that the engines of this invention may be operated in any desired position and that, therefore, these terms are only relative.

Figure 12:
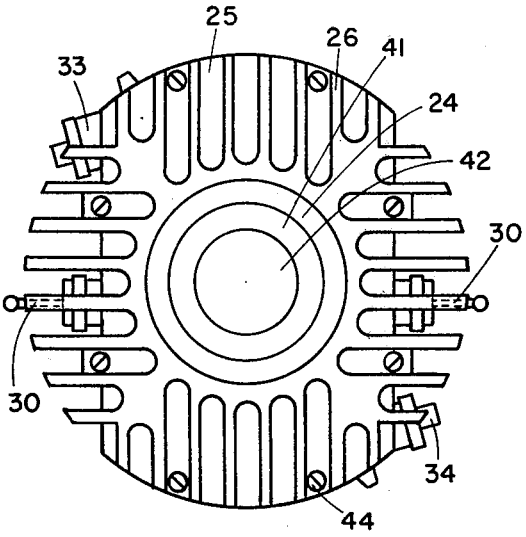
FIG. 12 is an external elevational view of the forward (power output) end of the engine of FIG. 10.
Figure 13:
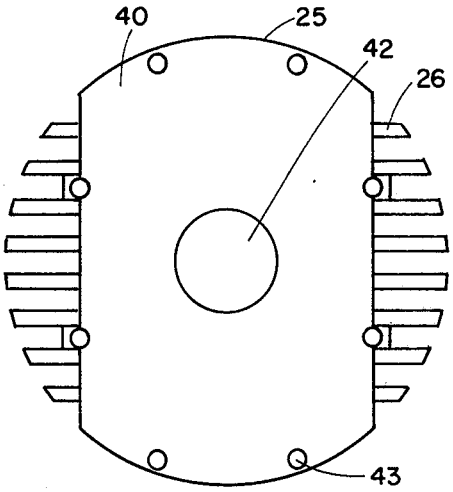
FIG. 13 is an internal elevational view of the forward housing block.
Figure 14:
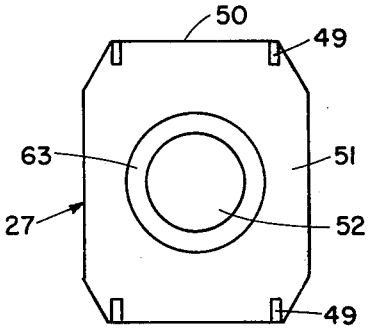
FIGS. 14–17 are front and back elevational, cross sectional and top elevational views respectively, of the orbiting piston.
Figure 16:
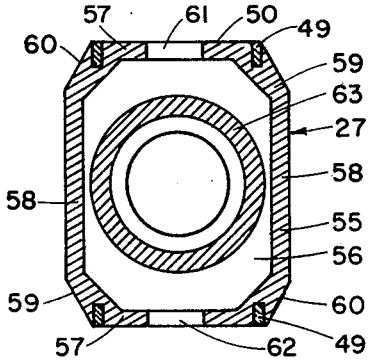
Figure 15:
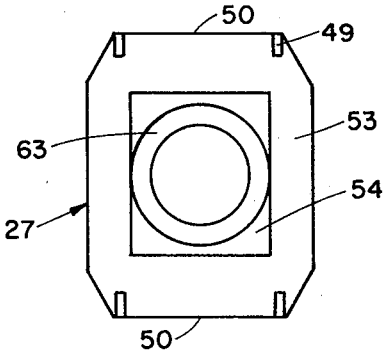
Figure 17:
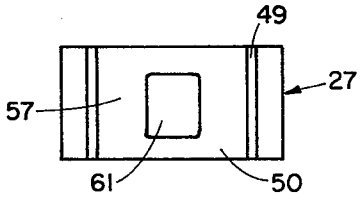
Figure 18:
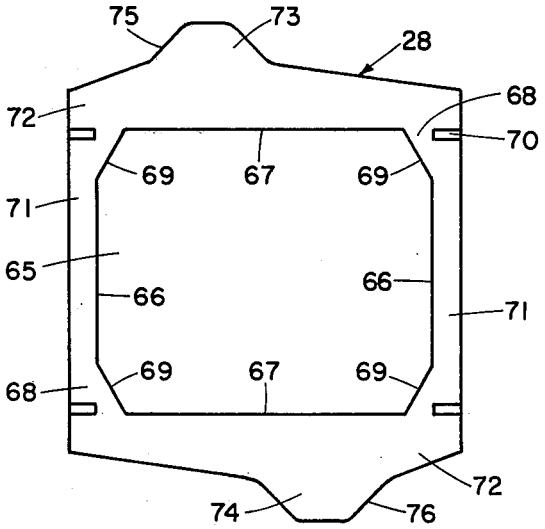
FIGS. 18–21 are front and side elevational, cross sectional and bottom elevational views of the moving combustion chamber member.
Figure 19:
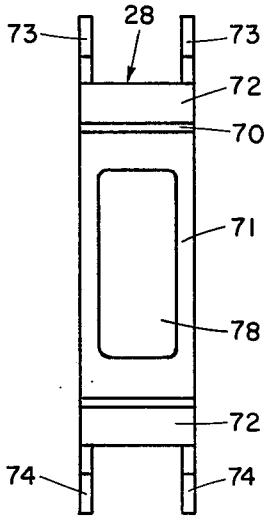
Figure 20:
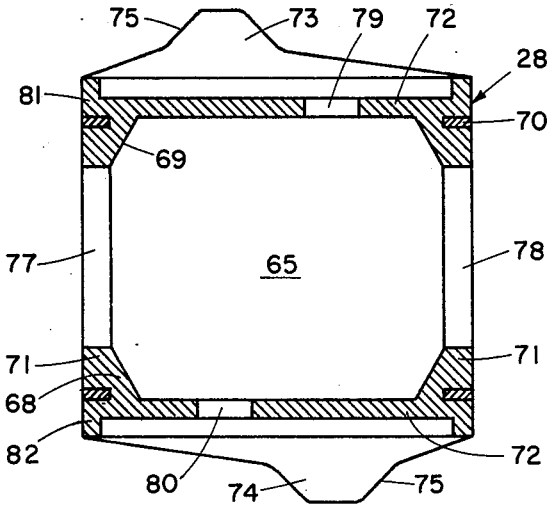
Figure 21:
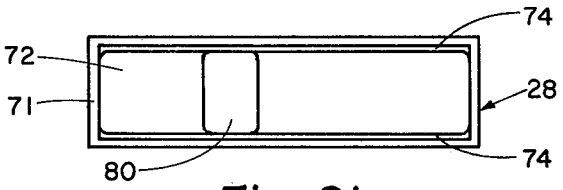

FIGS. 12 and 13 are external and internal elevational views of forward engine block 25. It will be seen that it comprises a central plate 40 having upper and lower circularly configured edges and joined by parallel edges. An annular bearing support 41 is provided within bearing housing 24 and around central crankshaft opening 42. A plurality of holes 43 are drilled around the edges of plate 40 to allow the insertion of bolts 44 to be used to assemble the engine as shown in FIG. 10.

FIGS. 14–17 are front and back elevational, cross sectional and end elevational views, respectively, of orbiting piston 27. This piston is provided with sliding seals 49 in contacting/sealing surface 50 and is constructed to have a front plate 51 with a central shaft opening 52; a back plate 53 with a shaft/exhaust opening 54; and a central member 55 defining a volume 56 within the orbiting piston. Central member 55 is formed to have parallel sides 57 and 58 joined through angled members 59 having edges 60, the length and configuration of which play an important role in opening and closing fuel/air induction ports in the engine as will be seen in FIGS. 30–32. The bearing housing 63 for the engine crankshaft is provided within volume 56 of the orbiting piston as described below in conjunction with FIGS. 26–28. Ports 61 and 62 are cut in sides 57 to interact with ports in the moving combustion chamber member 28.

FIGS. 18–21 are front and side elevational, cross sectional and end elevational views respectively of the moving combustion chamber member 28. It is constructed to provide for the back and forth reciprocation of the orbiting piston 27 within is central open volume 65 defined by parallel sides 66 and 67 joined through internally angled members 68, the inner edges 69 of which are identical in length and configuration to edges 60 of orbiting piston 27. Volume 65 is sized to permit orbiting piston 27 to reciprocate back and forth within it. Edge seals 70 are arranged to engage the internal walls of central power block 29.

Moving combustion chamber member 28 is formed of oppositely disposed parallel members 71 and 72, parallel members 72 having upper and lower porting extensions 73 and 74, the porting edges 75 and 76 and overall configuration of which are designed to control the flow through the fuel/air mixture induction ports during predetermined cycle intervals. As will be seen from FIGS. 19 and 20, sides 71 have oppositely disposed openings 77 and 78 cut in them through which the tip ends of spark plugs 30 extend; and as will be seen from FIGS. 20 and 21, sides 72 have ports 79 and 80 therein to interact with ports 61 and 62 of the orbiting piston. Internal upper and lower skirts 81 and 82 are provided to fit around filler pieces in the central power block to minimize the volume of any dead spaces or clearance volume.

Figure 22:
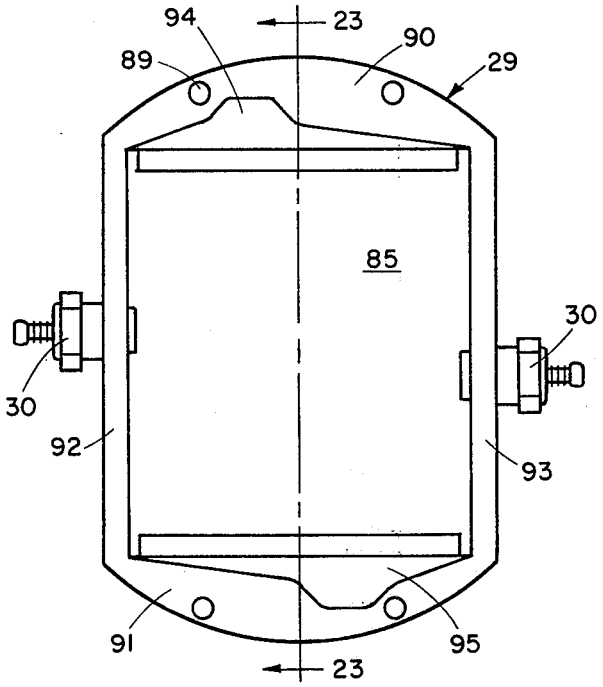
FIG. 22 is a front elevational view of the central power block.
Figure 23:
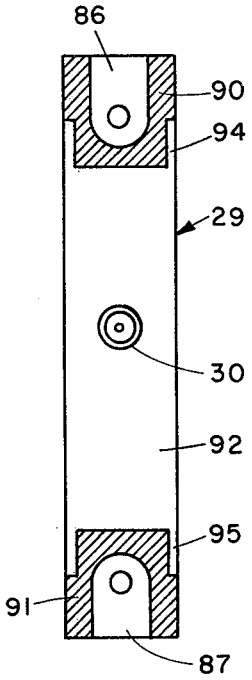
FIG. 23 is a cross section of the central power block taken through plane 23–23 of FIG. 22.

FIGS. 22 and 23 are front elevational and cross sectional views of central power block 29. Its purpose is to provide an engine volume 85 in which the moving combustion chamber member 28 is reciprocated by reason of the orbiting motion of orbiting piston 27 which reciprocates within moving chamber member 28. As will be seen below in connection with the discussion of FIG. 26, the secondary expansion chambers are defined within this chamber 85. This central power block 29 is constructed as a frame having an overall configuration identical to that of central plate 40 of forward engine block 25 (FIG. 13). Central power block 29 is conveniently formed as two joined halves having upper and lower channels 86 and 87 to make it possible to secure the halves with bolts 88 (FIGS. 10 and 11). Holes 89 are drilled in the circularly configured sides 90 and 91 for bolts 44 (FIG. 12) and spark plugs 30 are mounted in parallel sides 92 and 93. Sides 90 and 91 are constructed to have oppositely disposed shallow depressions 94 and 95 of a depth equal to the thickness of porting extensions 72 and 73 of moving combustion chamber member 28 (FIG. 20) and of the same configuration.

Figure 24:
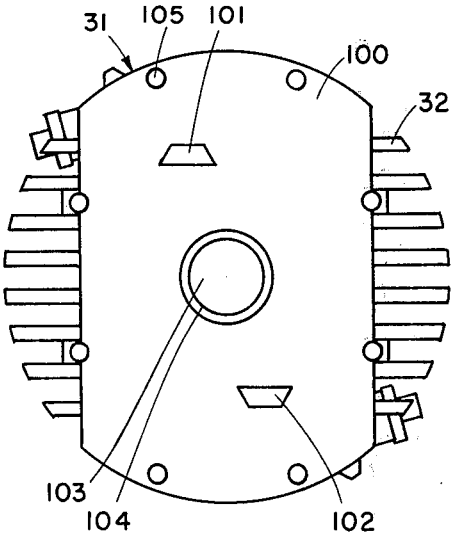
FIG. 24 is an elevational view of the internal wall of the housing block.
Figure 25:
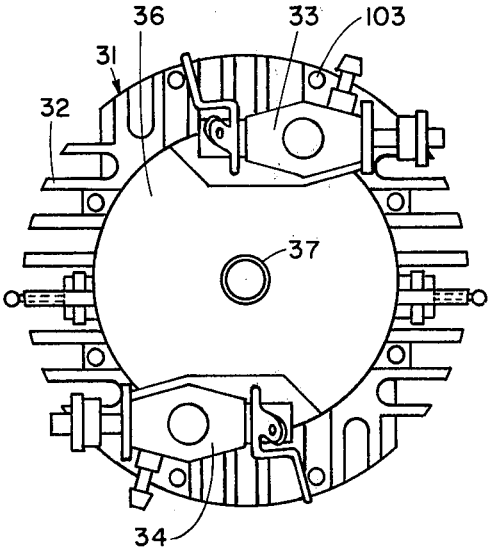
FIG. 25 is an elevational view of the external wall of the after housing block with the exhaust plate in position and the carburetors in place.

FIGS. 24 and 25 are internal and external side elevational views of the after engine block 31. It is formed of a central plate 100 to which the fins 32 are affixed or made integral with; and drilled through it are two fuel/air mixture induction ports 101 and 102 which are in fluid communication with carburetors 33 and 34. A central shaft opening 103, having a bushing 104, opens into bearing housing 35 (FIG. 11). Finally, a plurality of holes 105 corresponding in location to holes 44 (FIG. 12) and 89 (FIG. 22) are drilled through central plate 100 for bolting the after engine block onto the engine.

Figure 26:
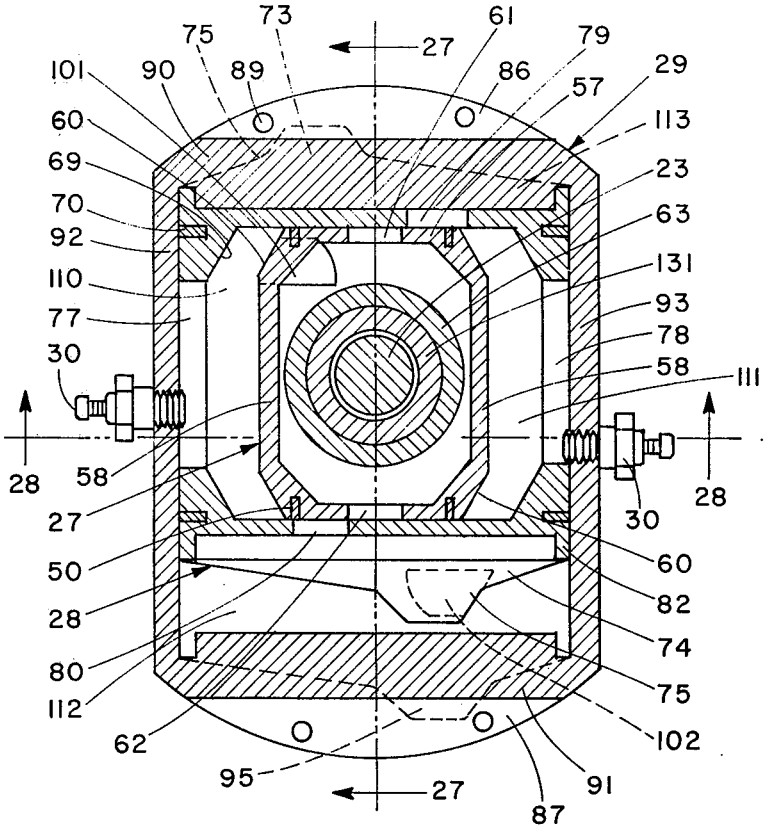
FIG. 26 is a cross section of the engine through the central power block taken transverse to the engine axis corresponding to an orbiting crank angle of 270°
Figure 29:
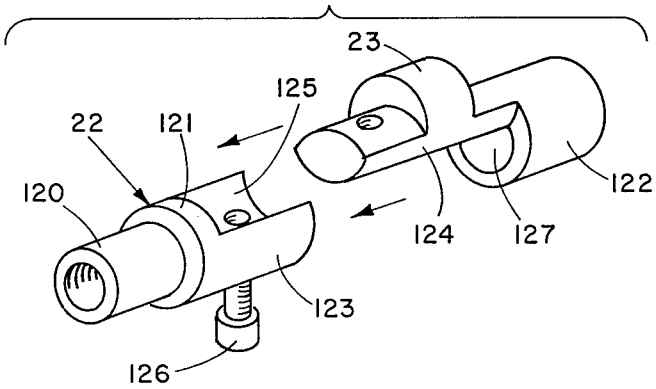
FIG. 29 is a perspective view of the components forming the crankshaft of the embodiment shown in FIGS. 27 and 28 prior to assembly.
Figure 27:
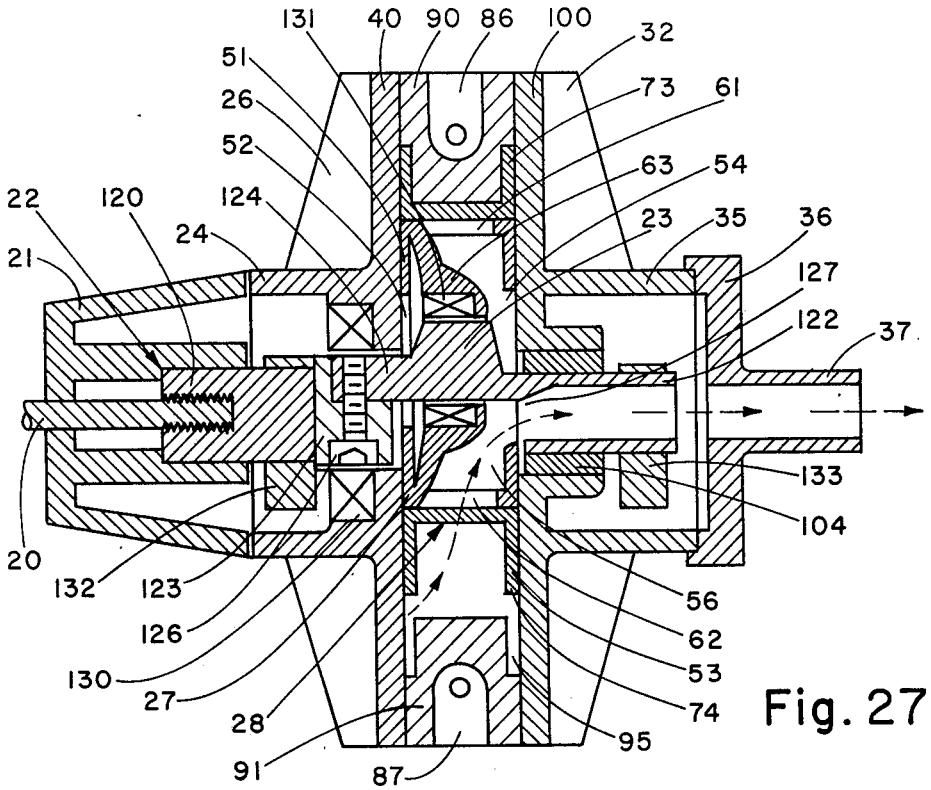
FIG. 27 is a cross section of the engine of FIG. 10 taken through plane 27–27 of FIG. 26.
Figure 28:
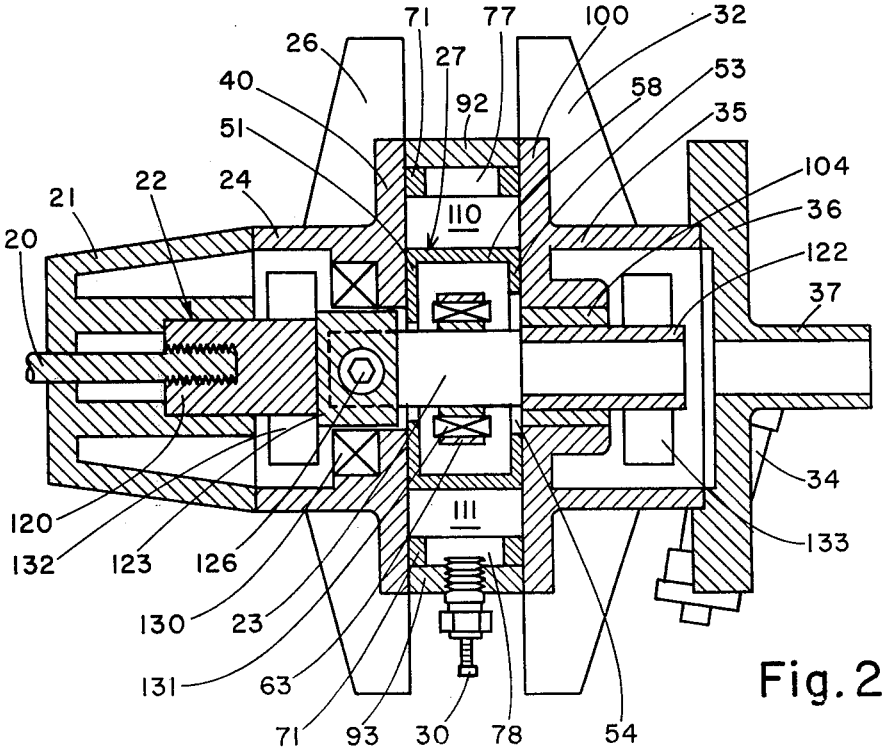
FIG. 28 is a cross section of the engine of FIG. 10 taken through plane 28–28 of FIG. 26.

FIGS. 26–28 are detailed cross sections of the assembled engine and FIG. 29 is a perspective view of the engine crankshaft. In these drawings, like reference numerals are used to identify like components shown in FIGS. 10–25. FIGS. 26–28 show the positions of orbiting piston 27 and moving combustion chamber member 28 corresponding to an engine crank angle of 90°.

The engine embodiment of FIGS. 10–29 is designed to provide opposing primary combustion/expansion chambers with associated opposing secondary expansion chambers. Therefore, the motion of orbiting piston 27 within volume 65 of moving combustion chamber 28 defines primary combustion/expansion chambers 110 and 111; while the motion of moving combustion chamber member 28 within volume 85 of central power block 29 defines secondary expansion chambers 112 and 113. Chambers 110 and 112 operate in association; while chambers 111 and 113 operate in association on the same cycle but 180° out of phase. For the combination of primary chamber 110/secondary chamber 112, port 101 serves as the fuel/air induction port, port 80 in moving combustion chamber member 28 as the interchamber port and port 62 (in orbiting piston 27) along with port 80 as the exhaust port. As will be seen in FIGS. 27 and 28, the combustion gases are exhausted through the central volume 56 of the orbiting piston and a hollow portion of the crankshaft into exhaust line 37. In like manner, for the combination of primary chamber 111/secondary chamber 113, port 102 serves as the fuel/air inlet port, port 79 in moving combustion chamber member 28 as the interchamber port and ports 61 and 79 along with central volume 56 and the after crankshaft segment, as the exhaust port. FIGS. 35–43, described below detail the flow of fluids through the engine during the cycle.

In the longitudinal cross sections of the engine shown in FIGS. 27 and 28, and in the perspective drawing of FIG. 29 the shaft means associated with the orbiting piston and moving combustion chamber means are detailed. Engine power is delivered through power shaft 20 which is rigidly affixed to crankshaft 22 which may be considered to be made up of a forward section 120, a middle section 121 and after section 122. Middle section 121 comprises a circular cylinder member 123 and a segment of a circular cylinder member 124 set in a circularly configured channel 125 in member 123 and rigidly affixed thereto by a countersunk screw 126. The orbiting piston shaft 23 is affixed to or integral with cylinder member 124, the axes of crankshaft 22 and orbiting piston shaft 23 being parallel and spaced apart a distance equal to the orbit radius of orbiting piston 27. After crankshaft section 122, which is in axial alignment with forward section 123 is hollow and joined to cylinder member 124 to provide a fluid exhaust port 127 to permit exhaust gases passing through the orbiting piston to be vented into bearing housing 35 and then to the atmosphere through exhaust line 37.

The crankshaft system is supported and maintained in alignment through crankshaft bearings 130, orbiting shaft bearing 131 and bushing 104. Counterweights 132 and 133 are affixed to forward crankshaft section 120 and after crankshaft section 122, respectively.

It is, of course, within the scope of this invention to use glow plugs in place of spark plugs 30. The choice of one or the other of these firing means will depend upon the choice of fuel used. The use of glow plugs is illustrated in FIGS. 64–66.

Another method of extracting exhaust products from chamber 112 is by means of a rotary valve. This rotary valve may be located in the central power block housing between chambers 112 and/or 113 and the outside atmosphere. Such a rotary valve may be driven by the main crankshaft to rotate continuously and to open as chamber 112 or 113 is decreasing in volume in order to force the contained exhaust products out of chamber 112 into the atmosphere, and to remain closed as chamber 112 is increasing in volume during the expansion function. This rotary exhaust valve may also incorporate additional external counterweights to achieve superior mechanical balance of the engine mechanism.

A unique method of port timing makes it possible for the engine of this invention to attain true dual-stage combustion/expansion utilizing the dual-expansion cycle mode of operation as outlined in connection with FIGS. 1–7. This port timing makes it possible to time the opening and closing of the interchamber ports as precisely as can be done with cam operated poppet valves. Moreover the opening of the fuel/air inlet ports, e.g., 101 and 102 (FIG. 26), can be accomplished without regard to when they must be closed and conversely they may be closed at any practical predetermined crankshaft angle without regard to when they must be opened. This independent opening and closing feature of the fuel/air induction ports is made possible because of the way orbiting piston 27 and moving combustion chamber member 28 move in relation to each other and to the after engine block through which the ports are cut. Thus orbiting piston 27 moves in a circular path with respect to the engine block and reciprocates back and forth within moving combustion chamber member 28. Through proper location and configuration of fuel-/air induction ports 101 and 102 with respect to the paths traveled by the orbiting piston and the moving combustion chamber member it is possible to open ports 101 and 102 with one of these moving members and to close them with the other. Either of these moving members can be used to open or close the ports in the engine of this invention. Thus if orbiting piston 27 opens a port, moving combustion chamber member 28 will close it; and if the orbiting piston closes a port, the moving combustion chamber member will open it. The choice of the member to open a port depends upon the particular function of that port. This will be illustrated for the different embodiments of the engine of this invention.

Figure 30:
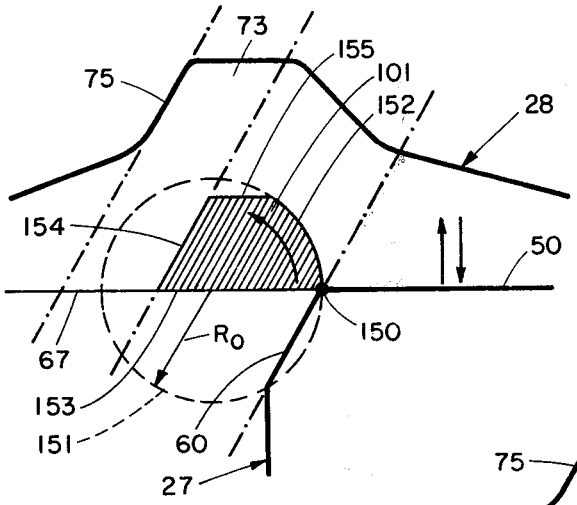
FIGS. 30–32 illustrate somewhat diagrammatically the role of the moving combustion chamber member and the orbiting piston in effecting the rapid opening and closing of the fuel/air induction ports.

In the case of the engine shown in FIGS. 10–29, the fuel/air induction ports 101 and 102 are opened by moving chamber member 28 and closed by orbiting piston 27 as illustrated in the enlarged diagram of FIG. 30. In order to describe the construction and operation of this porting system it should first be noted that all points on orbiting piston 27 travel in a circular path, the radius ROoI of which is the orbit radius of piston 27. Therefore, the point 150 on the corner of contacting surface 50 can be seen to travel along circular path 151, a path which defines one edge 152 of port 101. As it will be seen from this drawing, port 101 is so located and shaped that its opening edge 153 coincides in contour and angle to the edge of the moving member which opens it, i.e., to edge 67 of moving combustion chamber member 28. Likewise, the closing edge 154 of port 101 coincides in contour and angle to the edge of the other moving member which closes it., i.e., to edge 60 of orbiting piston 27. It will be seen from FIG. 30 that edge 60 remains parallel to closing port edge 154 as piston 27 orbits. The remaining edge 155 defining port 101 is parallel to opening edge 153, the distance between edges 153 and 155 being slightly less than $R_o$.

In addition to the marked advantage of being able to use the moving members as the sole means for opening and closing of ports, the porting system of the engine of this invention has another important advantage—it provides an ideal or optimum port time/area relationship. The ability of an internal combustion engine to take in and exhaust gases efficiently is directly related to how large its maximum port size can be made without having to resort to excessively large port opening times. Since the ports of this engine are rapidly opened by one moving member and rapidly closed by the other moving member, the maximum port size can be very large and the total time the port is opened relatively small. This means that gas transfer can occur more rapidly and efficiently in this dual-expansion engine than in the conventional two-stroke or four-stroke piston engines.

Figure 31:
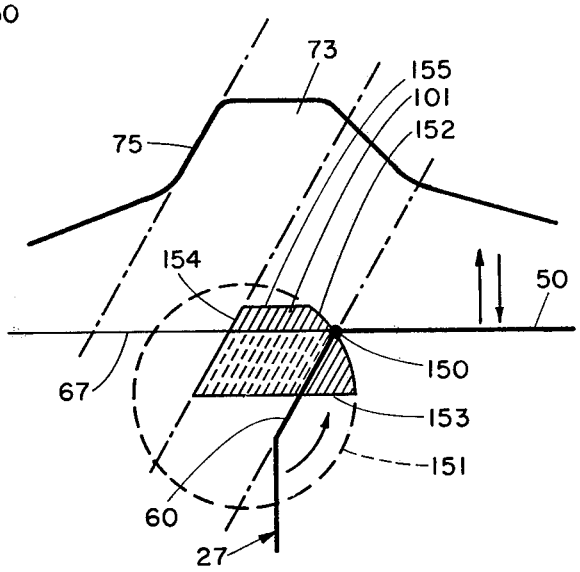
Figure 32:
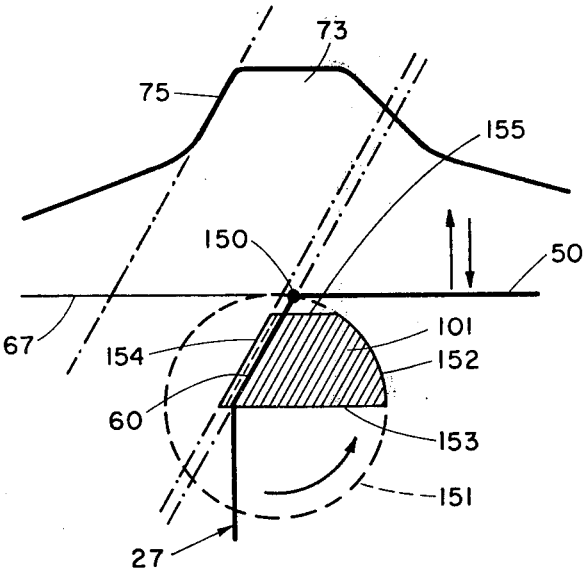
Figure 35:
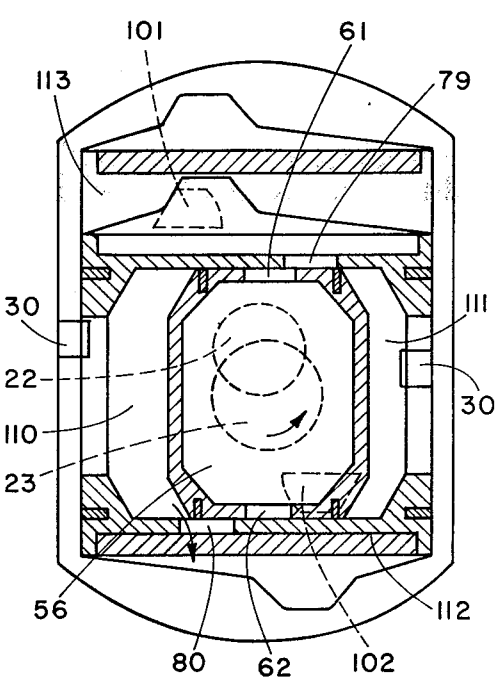
FIGS. 33–41 are sequential diagrams, partially in cross section, showing the operation of the engine of FIG. 10 operating as a dual-expansion engine to attain the PV diagram EABCDE of FIG. 9.

The operational sequence of the porting system of the engine of FIGS. 10–29 and the attainment of the desired fast open/fast close porting are shown in FIGS. 30–32 wherein solid line cross hatching of port 101 is used to indicate that the port is closed and broken line cross hatching is used to indicate that it is open. These FIGS. 30–32 represent, respectively, the positions of orbiting piston 27 and moving combustion chamber member 28 at approximately bottom dead center; at maximum port opening which takes place some 45° after opening; and at a point near full closing which takes place at about 80° after bottom dead center. From these sequential drawings it will be seen that a very large port opening area is possible even though the total crank angle in which the port is open is only about 90°. The use of the moving members makes this possible. As seen in FIGS. 30–32, port 101 is initially opened by edge 67 of moving combustion chamber member 28. Immediately after edge 67 opens the port, the angled edge 60 of orbiting piston 27 begins to close it. Port 101 is opened very rapidly because edge 67 is moving at essentially its maximum upward vertical velocity as moving combustion chamber member 28 moves upwardly. The closing of port 101 begins very slowly; but as it reaches its maximum opening (FIG. 31) edge 60 of orbiting piston 27 closes it about as rapidly as it is opened by edge 67.

The net result of the unique port configuration and mechanism for opening and closing it results in an effectively large port area occurring over an extended crank angle portion of the total port opening angle. By the time port 101 is closed, the velocity of edge 67 has been reduced to zero and edge 60 has its maximum length extending across port 101 and is travelling at its maximum velocity to effect the desired rapid closing. Fuel-/air induction port 102 is, of course, opened and closed in the same manner.

FIGS. 33–41 are sequential cross sectional drawings showing the operation of the engine, the construction of which is detailed in FIGS. 10–29. The drawings in these figures are somewhat simplified, e.g., only the moving parts and a portion of the central power block housing are cross hatched, the spark plugs are indicated by the outlines, the seals are omitted, and the internal constructional details of the orbiting piston are omitted except for an indication of crankshaft 22 and piston shaft 23 which are dotted in. The reference numerals used are the same as those used in FIGS. 10–29 and only those elements or components which enter into the actual operational cycle are identified.

Figure 33:
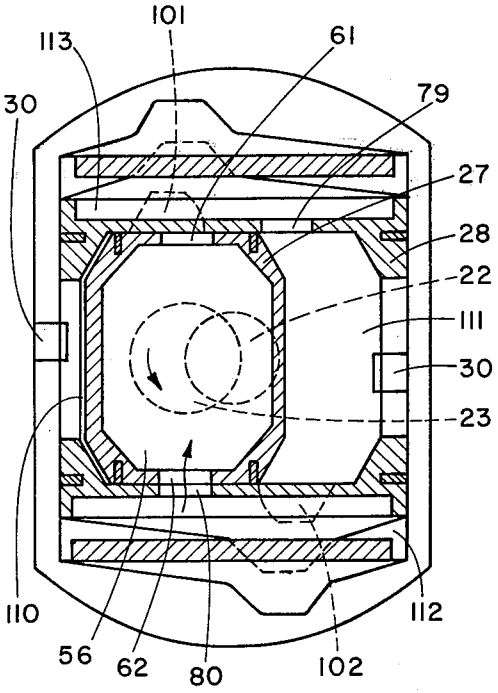

In FIG. 33, orbiting piston 27 is at top dead center, i.e., at 0° crank angle. (Reference should also be had to FIG. 8 in the following discussion of FIGS. 33–41.) It will be seen that primary combustion/expansion chamber 110 is at minimum volume and that exhaust gases from the preceeding cycle are being discharged to the atmosphere from secondary expansion chamber 112 through ports 80 and 62, volume 56 of orbiting piston 27, after section 122 of the crankshaft and exhaust line 37 (see FIG. 27). Angular crankshaft momentum and pressure within chamber 110 drive crankshaft 22 in a counterclockwise direction to initiate primary expansion in chamber 110. This results in combustion chamber member 28 being driven in that direction which reduces the volume of secondary expansion chamber 112 and which continues to force combustion gases therefrom. At a crank angle of approximately 20° before top dead center, the compressed fuel/air mixture in chamber 110 is ignited, and after completion of ignition the hot combustion gases continue to drive orbiting piston 27 toward its bottom dead center thus completing the exhausting of the gases from the previous cycle out of chamber 112.

When the volume of secondary expansion chamber 112 reaches essentially zero (FIG. 35), e.g., at a crank angle of about 100° (FIGS. 8 and 35) port 80 begins to open, thus beginning the secondary expansion. The opening of port 80 is effected by the sliding action of orbiting piston 27 within combustion chamber member 28. The resulting pressurization of chamber 112 provides the force necessary to continue driving the orbiting piston 27 in its counterclockwise direction and applying power to the crankshaft. The expansion of the highpressure combustion gases continues in both chambers 110 and 112 (FIG. 37) until the combined volumes of these chambers has reached a value of at least about two times the volume of chamber 110 at the time transfer began into chamber 112, i.e., the point in the cycle illustrated in FIG. 35. At the point illustrated in FIG. 36 the pressure in chamber 110 and 112 approaches atmospheric or slightly below atmospheric, bringing the cycle in condition for the induction of the fuel/air mixture from the carburetor.

Figure 38:
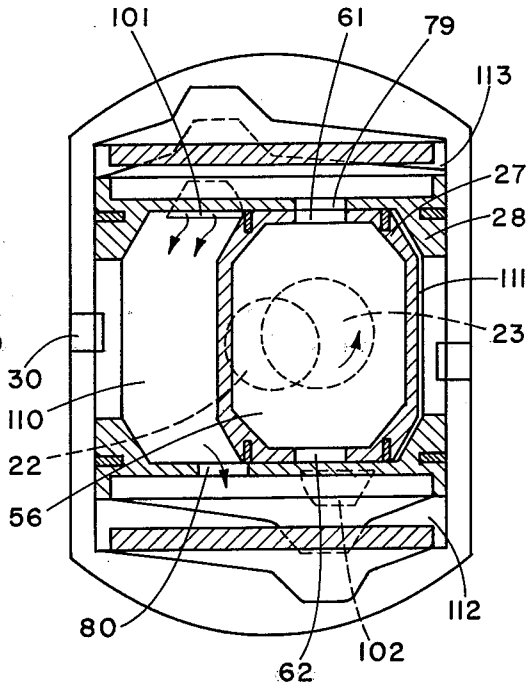
Figure 40:
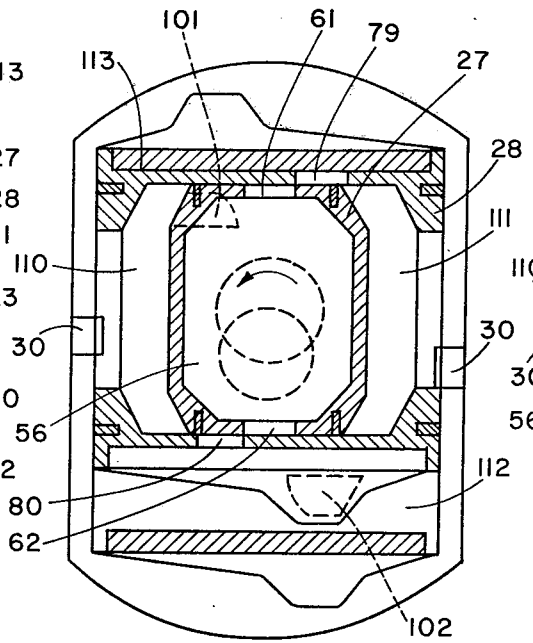

With a slightly negative pressure established in chamber 110 and 112, orbiting piston 27 and moving combustion chamber 28 are in position to bring about the rapid opening of port 101 (FIGS. 30 and 38). As will be seen in FIG. 39, the volume of secondary expansion chamber 112 continues to increase, a fact which means that the slight negative pressure within the engine results in the rapid induction of the fuel/air mixture through port 101 which reaches its maximum opening at a crank angle of about 225°. This permits a highly efficient form of scavenging and results in primary combustion/expansion chamber 110 being filled with the fuel/air mixture just as fluid communication, through ports 62 and 80, between chamber 110 and 112 is cut off (FIG. 40). At this fluid cut-off point, port 101 is closed through the movement of orbiting piston 27 and moving combustion chamber member 28 as explained above in connection with FIGS. 30–32.

From FIGS. 37–40 it will be seen that the discharge of the combustion gases and induction of the fuel/air mixture is accomplished by a unidirectional pull-through technique which moves the combustion gases downwardly through primary combustion chamber 110 by means of the slight negative pressure created in chamber 110 through the continued expansion of chamber 112. It may be postulated that this porting and expansion of gases results in a minimum mixing of the fuel/air mixture with the exhaust gases as the separate mixtures travel through combustion chamber 110. A slight mixing at the interface line undoubtedly occurs which will help reduce the final oxides of nitrogen in the exhaust products. One important advantage of this induction technique is that throttling losses are much lower than encountered in standard four-stroke engines. The minimal effect of throttling losses in the engine described occurs because the minumum pressure attainable is about one-half atmospheric pressure or about 8 psia with a fully closed throttle.

Finally as orbiting piston 27 approaches its top dead center position (FIG. 41), ports 62 and 80 are again realigned through the relative motion of piston 27 and combustion chamber member 28 to allow the combustion gases from secondary expansion chamber 112 to exhaust to the atmosphere. With the attainment by orbiting piston 27 of its top dead center position (FIG. 33), the cycle begins again.

Figure 37:
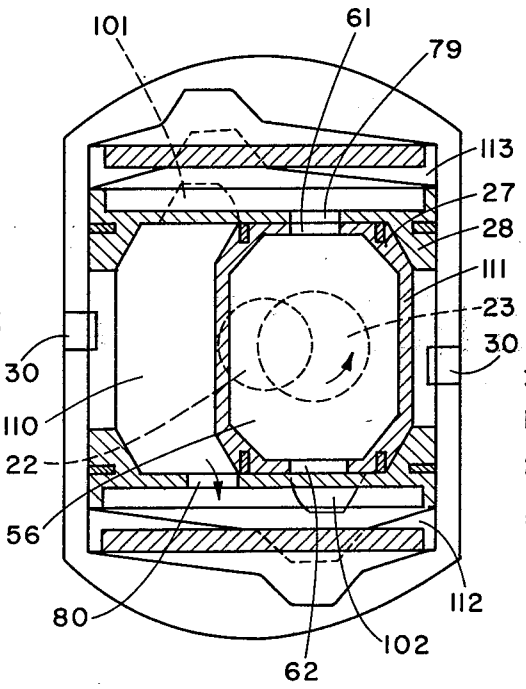
Figure 36:
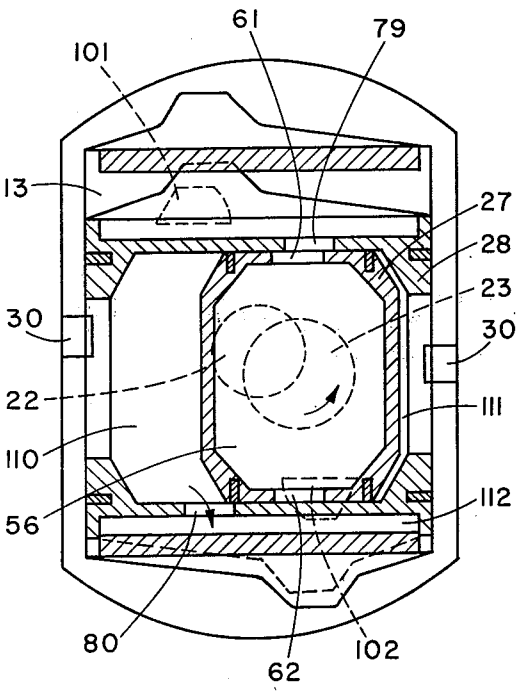
Figure 41:
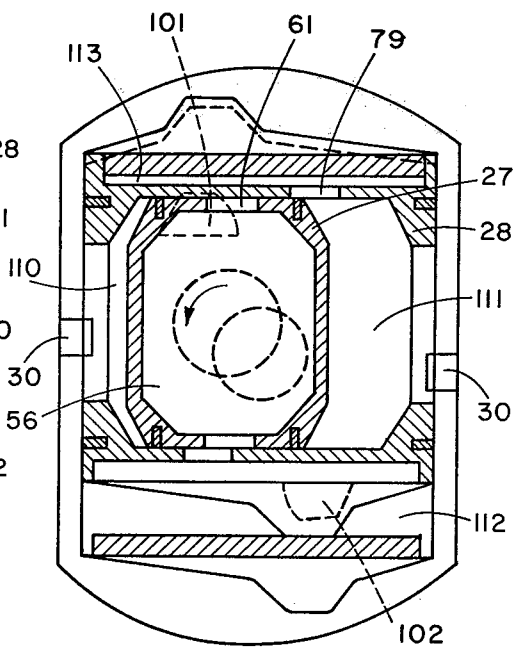

In the apparatus embodiment of FIGS. 10–29, there are provided two opposed sets of primary combustion-/expansion and secondary expansion chambers, i.e., chambers 110 and 112 forming one set and chambers 111 and 113 the other set. Fuel/air induction port 102 in communication with carburetor 34 (FIG. 25) is associated with this set of chambers. Both sets of chambers operate on the above-described cycle and are 180° out of phase with each other. Thus for primary combustion-/expansion chamber 111 and secondary expansion chamber 113 top dead center is shown in FIG. 37, and the cycle proceeds through FIGS. 38–41 and then FIGS. 33–36.

From the above description of the cycle of this invention it will be seen that the role of the secondary expansion chamber, e.g., chamber 112, is unique and serves several functions in the cycle. Its first function is to begin to accept high-pressure combustion gases when its volume is at a minimum, e.g., some 2% to 5% of its maximum volume, allowing for some unavoidable dead space. The minimizing of wasted transfer volume in turn maintains transfer losses at a minimum. Since secondary expansion chamber 112 receives combustion gases at a time when continued expansion work is being accomplished it continues to turn the crankshaft to give increased fuel economy.

A second function of secondary expansion chamber 112 is to "pull" the fuel/air mixture into primary combustion/expansion chamber 110 from port 101. The combined volume expansion of chambers 110 and 112 past the point of transfer is so great that the combustion gas pressure is reduced to a point equal to the external atmospheric pressure when the orbiting piston is about 20° to 30° before its bottom dead center position. Further travel of moving combustion chamber member 28 upwardly reduces the pressure within the engine to slightly below atmospheric.

Yet another function of the secondary expansion chamber 112 is to expel the spent exhaust gases from the engine at a sufficiently low enough temperature to permit the exhaust gases to pass through the center of orbiting piston 27. The low temperature of the exhaust gases, e.g., about 250° F. (120° C.) makes the engine of this invention particularly attractive for use in hand-held tools such as chain saws and the like. Any corrosive effects of these gases passing through the interior of the engine may be counteracted by proper seal and bearing selections. Exhaust blow-down noise has been completely eliminated, in fact some inward rushing of atmospheric air exists when the exhaust porting is opened at low power settings due to the throttled conditions. This in turn eliminates the need for any type of muffler on the engine which results in a decrease in weight and in engine manufacturing cost.

Figure 42:
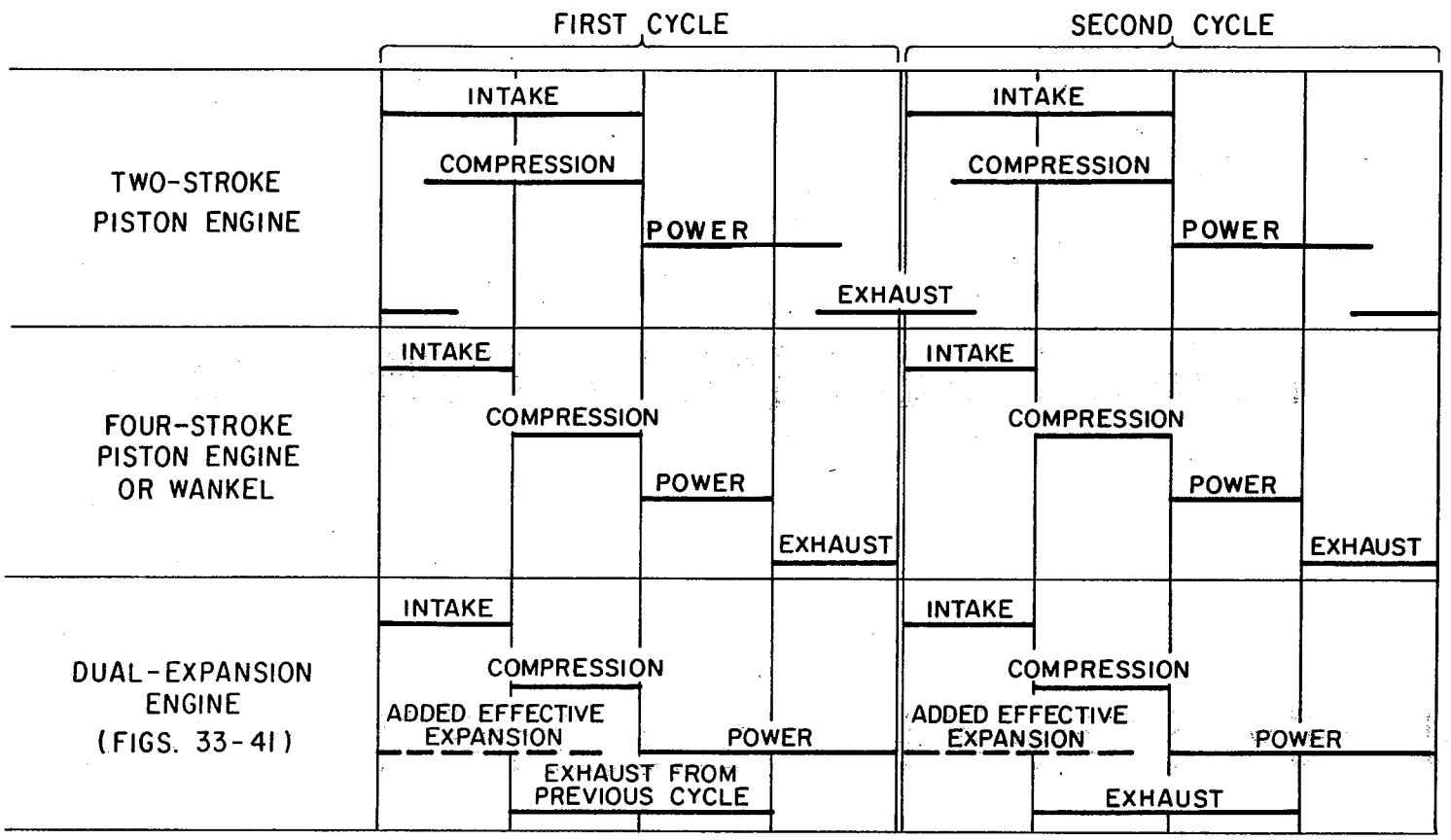
FIG. 42 is a chart comparing the functioning of different piston engine cycles, i.e., a two-stroke piston cycle, a four-stroke piston cycle, a Wankel cycle, and the orbiting piston engine of this inventon.

FIG. 42 charts a comparison of the functioning of three types of internal combustion piston engines. It will be seen that the engine of this invention is markedly different from the presently used two-stroke engine in that its intake and compression steps do not overlap in time and it effectively delivers power throughout almost the entire cycle. Although this engine more nearly resembles a four-stroke engine, with regard to intake and compression timing, it will be seen that it differs materially with respect to its ability to deliver power and to the timing of the exhaust portion of the cycle. The net results of the differences shown in FIG. 42 is the attainment by the engine of this invention of the most favorable characteristics of the two- and four-stroke engines along with added features which result in high thermal efficiency.

In the engine detailed in FIGS. 10—29, there are provided opposed sets of the two chambers. It is also within the scope of this invention to apply the unique cycle described to engine embodiments using but one primary combustion/expansion chamber with a secondary expansion chamber. Exemplary of such embodiments are the engines illustrated in FIGS. 43–52.

Figure 45:
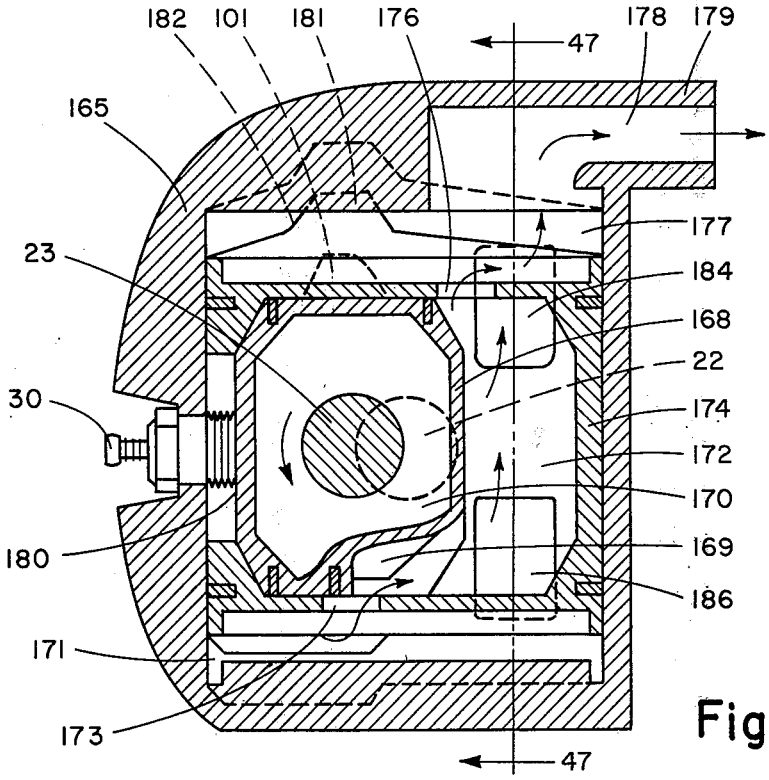
Figure 46:
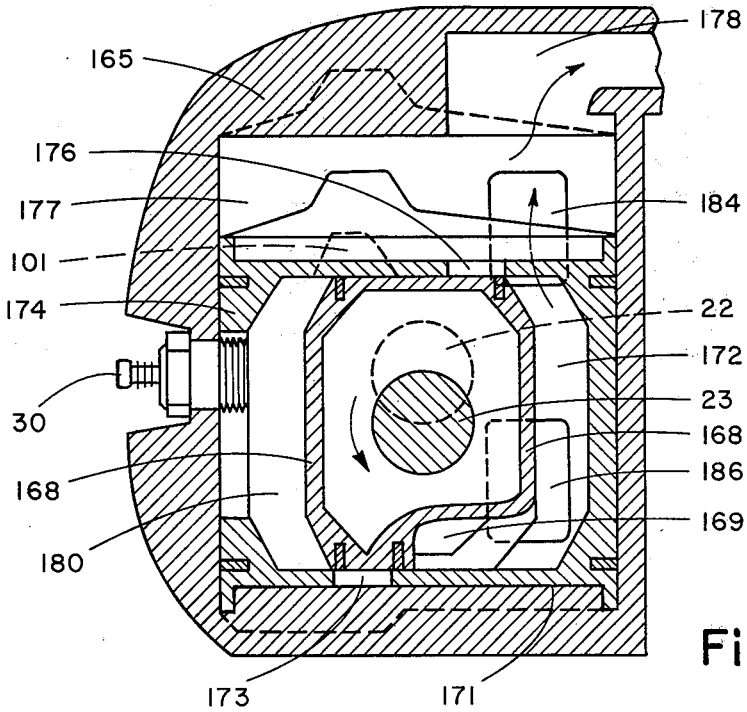
Figure 47:
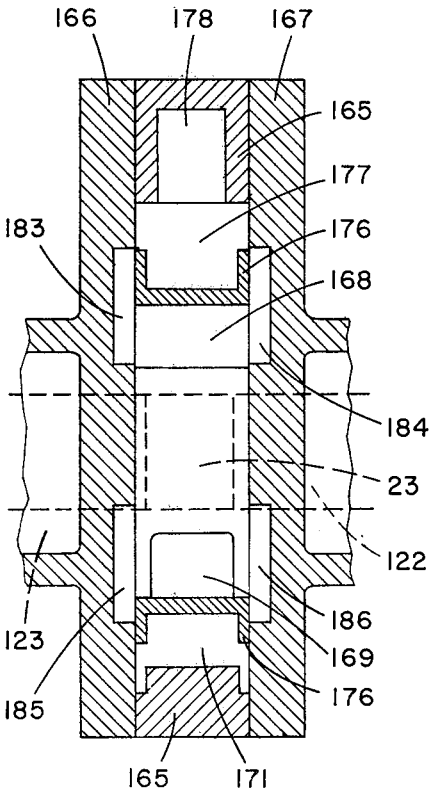
FIG. 47 is a cross section of the engine of FIGS. 43–46 taken through plane 47–47 of FIG. 45.

The engine embodiment of FIGS. 43–47 employs a suction chamber and an exhaust chamber which is continuously open to the atmosphere. FIGS. 43–46 are cross sections through the central power block 165 which may be mounted between a suitably configured forward engine block 166 and an after engine block 167 (FIG. 47). Heat transfer fins, a carburetor, shaft bearings, and similar components are not shown inasmuch as they can be similar to those shown for the engine of FIGS. 10–29. The orbiting piston 168 is configured the same as orbiting piston 27 (FIG. 16) except that it has a side port 169 providing fluid communication through only the lower part of the interior volume 170 of piston 168, between the secondary expansion chamber 171 and suction chamber 172. Port 173 in moving combustion chamber member 174, in conjunction with side port 169, provides the control of fluid flow between chambers 171 and 172. Orbiting piston 168 has port 175 which, in conjunction with port 176 of moving combustion chamber member 174, provides for the control of fluid flow between the interior volume 170 and exhaust chamber 177 which opens up into an exhaust volume 178 which in turn remains open to the atmosphere through exhaust pipe 179. A fuel/air induction port 101 communicates with a carburetor as previously described to bring in the fuel/air mixture into primary combustion/expansion chamber 180. Moving combustion chamber member 176 has a porting extension 181 and porting edge 182; and the fuel air induction porting system for this engine is identical to that previously described with reference to FIGS. 30–32. The crankshaft assembly is the same as shown in FIG. 29, except for the fact that after section 122 may be solid inasmuch as the exhaust gases are not discharged through the crankshaft. Cut into the forward and after engine blocks 166 and 167 are opposed upper side ports 183 and 184 and opposed lower side ports 185 and 186 (FIG. 47), the role of which will become apparent in the following description of the operation of the embodiment as depicted in the sequential drawings of FIGS. 43–46.

Figure 43:
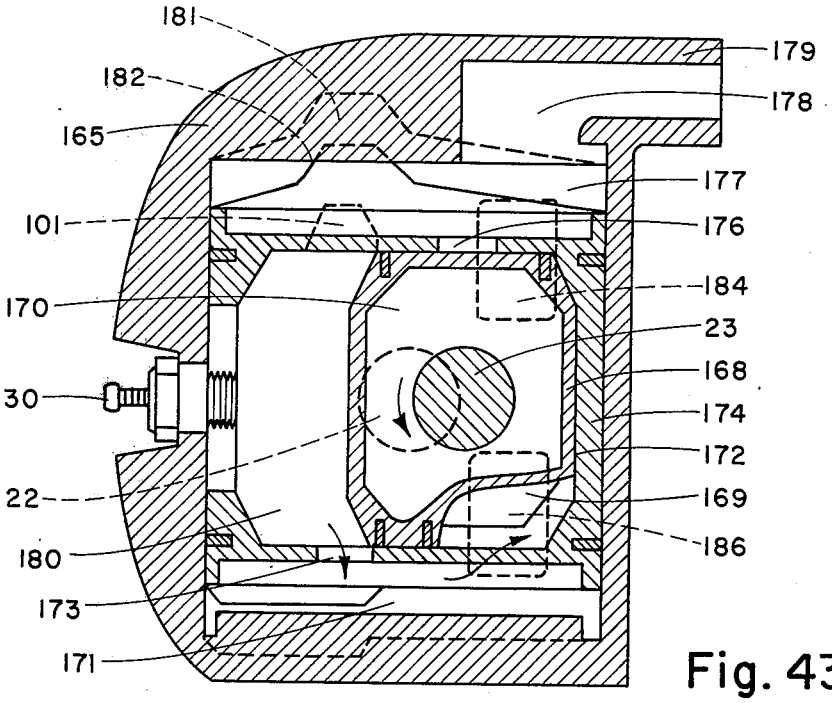
FIGS. 43–46 are cross sectional views taken normal to the crankshaft axis of an embodiment of the engine of this invention incorporating a single set of primary combustion/expansion and secondary expansion chambers along with a suction chamber, illustrating the sequential motion of the orbiting piston and the moving combustion chamber member through a cycle of operation.
Figure 44:
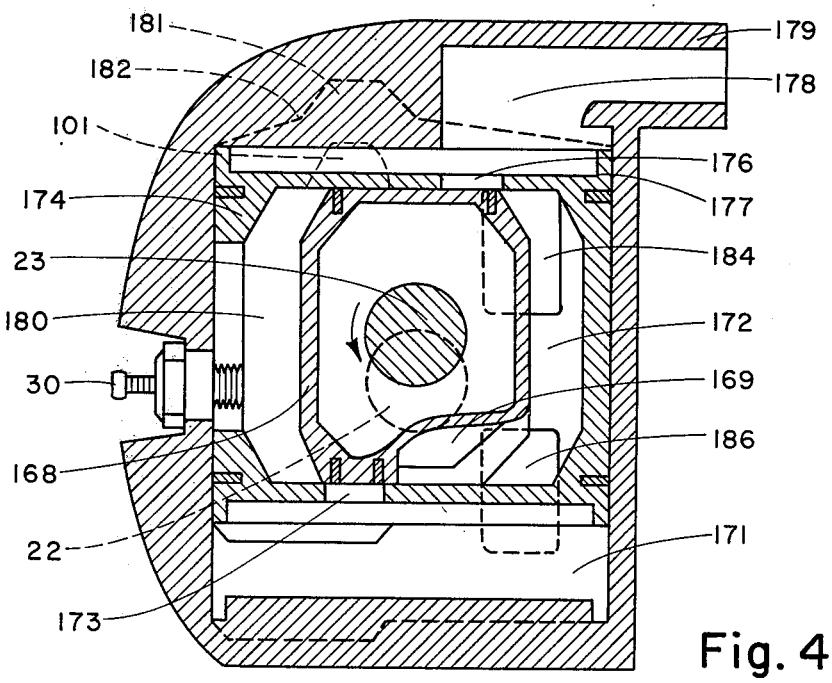

FIG. 43 illustrates the bottom dead center position for the orbiting piston and compares to FIG. 37 as far as the cycle concerns primary combustion/expansion chamber 180 (corresponding to chamber 110) and secondary expansion chamber 171 (corresponding to chamber 112); FIG. 44 corresponds to FIG. 40; FIG. 45 represents top dead center and corresponds to FIG. 33; and FIG. 46 corresponds approximately to FIG. 35. Therefore, as far as the functions of chambers 180 and 171 and the porting of fuel/air induction port 101 are concerned, they are the same as previously described. The difference in operation between the engine of FIGS. 43–47 and that of FIGS. 10–29 is that suction chamber 172 is open to secondary expansion chamber through side ports 185 and 186 during that time in the cycle when suction chamber 172 is increasing in volume (FIGS. 43 and 44). Therefore, as chamber 172 increases in volume it causes a further pressure drop in secondary expansion chamber 171 by virtue of gas flow through lower side ports 185 and 186. Moreover, so long as port 173 remains open to provide fluid communication between chambers 180 and 171 (i.e., up to that point just before FIG. 44) the pressure in primary combustion/expansion chamber 180 continues to be reduced until it reaches a level which is below that attainable in chamber 110 of the engine of FIGS. 10–29. This reduction in pressure has the net effect of increasing the fuel/air mixture flow rate through port 101 into chamber 180 (between positions shown in FIGS. 43 and 44) and of increasing volumetric efficiencies.

As orbiting piston 168 travels from top dead center (FIG. 45) to the combustion chamber member bottom dead center (FIG. 46), suction chamber 172 is open to both secondary expansion chamber 171 through ports 173 and 169 and to exhaust chamber 177 and 178 through upper side ports 183 and 184. This makes possible the removal of the exhaust gas from chamber 171 by the time the chamber reaches its minimum volume (FIG. 46).

The relatively large total port areas provided in the engine of FIGS. 43–47 result in low pumping losses in transferring the exhaust gases into chamber 178 from chamber 172. Since the exhaust gases are not discharged through the after section of the engine crankshaft they need not enter the central part of the orbiting piston and problems associated with providing seals and bearings capable of resisting the corrosive effects of the exhaust gases are materially alleviated.

FIGS. 48–51 illustrate another embodiment of the engine of this invention using a single primary combustion chamber with two variable volume chambers, one serving as the secondary expansion chamber and the other as a pressure/pumping chamber. The embodiment of FIGS. 48–50 comprises a central power block 195 sealed between a forward engine block 196 and an after engine block 197 and having an exhaust pipe 198. Appropriate heat transfer surfaces 199 are provided for cooling the engine. The moving combustion chamber member 200 has an upper reinforcing extension 201 and a corresponding balancing lower extension 202. It also has oppositely disposed ports 203 and 204 which remain open, the former for clearance of spark plug 30 and the latter for communication with exhaust pipe 198. Two ports 205 and 206 communicate with pressure pumping chamber 207 and secondary expansion chamber 208, respectively, and these are controlled by the sliding motion of orbiting piston 209. Orbiting piston 209 has a bottom/side port 210 communicating with exhaust chamber 211 and a sliding port 212 providing fluid communication between internal volume 213 of orbiting piston 209 and pressure pumping chamber 207 through port 205. A fuel/air induction port 214 is cut through into a connecting channel to port 225 and has a configuration, similar to that illustrated in FIG. 30, which is opened and closed by the motion of the moving combustion chamber member 200 and orbiting piston as previously explained with respect to FIGS. 30–32.

The fuel/air mixture from a carburetor (not shown) is inducted into the engine through two oppositely disposed conduits 218 and 219 formed by appropriately configured troughs 220 and 221 sealed along the after crankshaft section 122. Conduits 218 and 219 terminate within internal volume 213 of the orbiting piston which is in sequenced fluid communication with pressure/-pumping chamber 207 through passages 222 and 223 drilled in forward and after engine blocks 197 and 198 and terminating in ports 224 and 225. As will be seen in FIGS. 48 and 50, passage 222 is cut at such an angle that its side wall coincides with closing edge 226 of fuel/air induction port 214 which is also cut into, but not through, after engine block 197.

Figure 48:
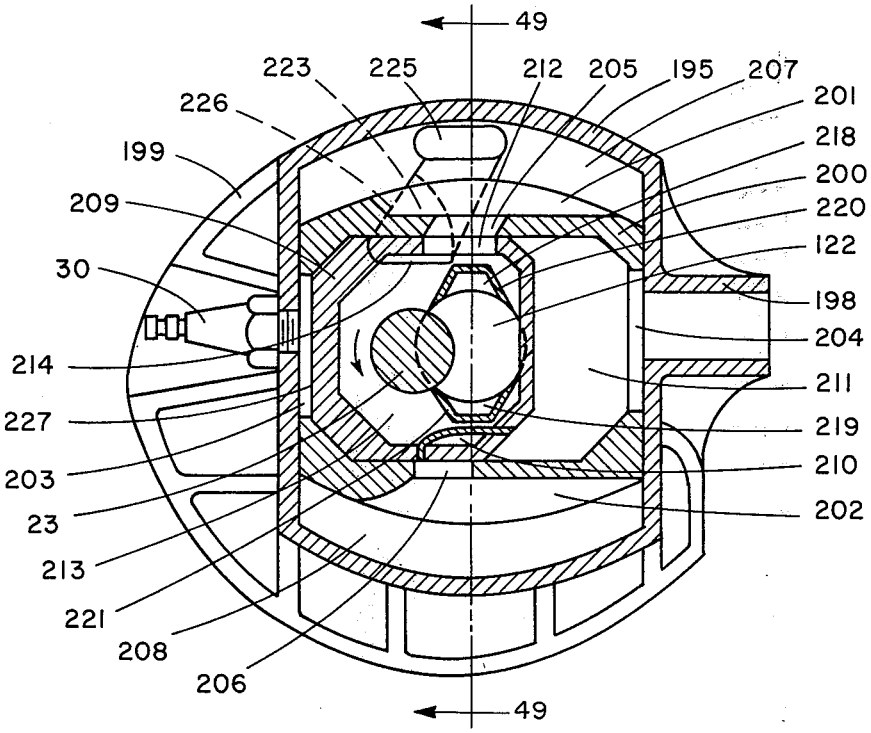
FIG. 48 is a cross sectional view of another embodiment of the engine incorporating a single set of combustion and expansion chambers along with condensing and pumping chambers, showing the orbiting piston at top dead center.

In the operation of the embodiment of FIGS. 48–51 the reciprocating motion of sliding port 212 in the orbiting piston relative to port 205 in the moving combustion chamber member 200 controls the flow of the fuel/air mixture into pressure pumping chamber 207 such that the fuel/air mixture is drawn into chamber 207 as it is increasing in volume (FIG. 48). Subsequently, as chamber 207 decreases in volume (FIG. 50) ports 212 and 205 are closed off and ports 214 and 225, with their connecting channel 222, are opened so that the fuel/air mixture is pumped from chamber 207 into primary combustion-/expansion chamber 227 by way of these ports. Secondary expansion in secondary expansion chamber 208 is carried out as described for the engine embodiment of FIGS. 10–29. Chamber 211 is arranged to function as a condensing chamber prior to the exhausting of the combustion products. Condensing chamber 211 is continually open to the atmosphere through exhaust pipe 198.

Figure 51:
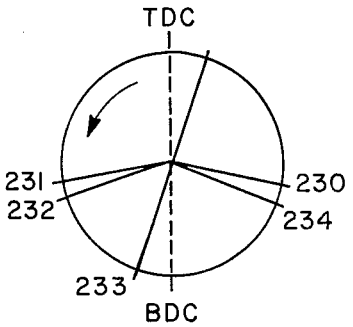
FIG. 51 is a timing diagram for the engine embodiment of FIGS. 48–50.

FIG. 51 presents a timing diagram relative to the position of the orbiting piston as it moves in a counterclockwise direction. FIG. 48 corresponds to top dead center (TDC), and FIG. 49 to bottom dead center (BDC). Thus between the positions of the orbiting piston shown in FIGS. 48 and 50, moving combustion chamber member 200 has moved just downwardly to achieve minimum volume for secondary expansion chamber 208 and maximum volume for pressure/pumping chamber 207 and then upwardly to the position of FIG. 50. Likewise between the positions shown in FIGS. 48 and 50, chamber 208 attains maximum volume and chamber 207 minimum volume as the crankshaft continues through 180°.

During the downward motion of combustion chamber member 200, port 212 in the orbiting piston remains in fluid communication with port 205 of the combustion chamber member thus allowing the fuel/air mixture to enter pressure/pumping chamber 207 through oppositely disposed conduits 218 and 219, volume 213, conduits 222 and 223, and ports 224 and 225. Ports 205 and 212 remain in communication between points 230 and 231 of the timing diagram of FIG. 51. At point 231 chamber 207 has become filled with the air/fuel mixture ready to be pumped into primary combustion/expansion chamber 227. Simultaneously with the filling of pressure pumping chamber 207, the residual combustion gases in secondary expansion chamber 208 are being pumped out through ports 206 and 210 into condensing chamber 211 and then through exhaust pipe 198. Ports 206 and 210 are in fluid communication between points 230 and 231 of FIG. 51. Shortly thereafter at point 232 orbiting piston 209 reaches the point where port 206 opens communication between chamber 227 and 228 to begin the transfer of high-pressure gas into the secondary expansion chamber. Port 214 is opened at point 233 to allow the fuel/air mixture to be pumped from chamber 207 into chamber 227. At approximately this same point the pressure in chamber 208 has been reduced to below the pressure in chamber 207 to provide suction of the fuel/air mixture into chamber 227. Thus from point 233 to point 234 in FIG. 51 combustion chamber member 200 travels upwardly to pump the fuel/air mixture into chamber 227 from chamber 207 and to lower the pressure in chamber 208 thus effecting an efficient push-pull scavenging of combustion chamber 227.

Because of the pressure-suction feature of the engine embodiment of FIGS. 48–51 it can operate at higher RPM and higher power levels due to its ability to expand the highpressure gases within secondary expansion chamber 208. Pressure induction through the use of chamber 207 can effectively increase volumetric efficiency in the higher speed range thus allowing more air to be transferred to the combustion chamber before compression begins. The combination of a pressure induction and a suction induction function from secondary expansion chamber 208 allows a push-pull situation which assures complete evacuation of exhaust products and replacement with ample fuel/air mixture in this embodiment. This push-pull feature results in an essentially zero pressure interface between the entering fuel-/air mixture and the exiting exhaust products which results in essentially no mixing of the fuel and air with exhaust gases as they move in tandem downwardly through the combustion chamber. Less mixing of these components will result in a more efficient and higher intensity of combustionexpansion stroke, although it may promote a higher percentage of oxides of nitrogen. However, any undesirable pollutants may be controlled by exhaust gas recirculation methods.

Figure 49:
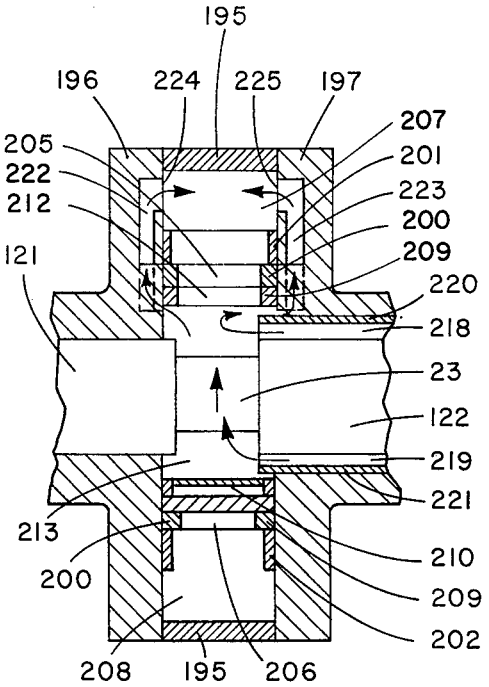
FIG. 49 is a cross section of the engine of FIG. 48 taken through plane 49–49 of FIG. 48.
Figure 50:
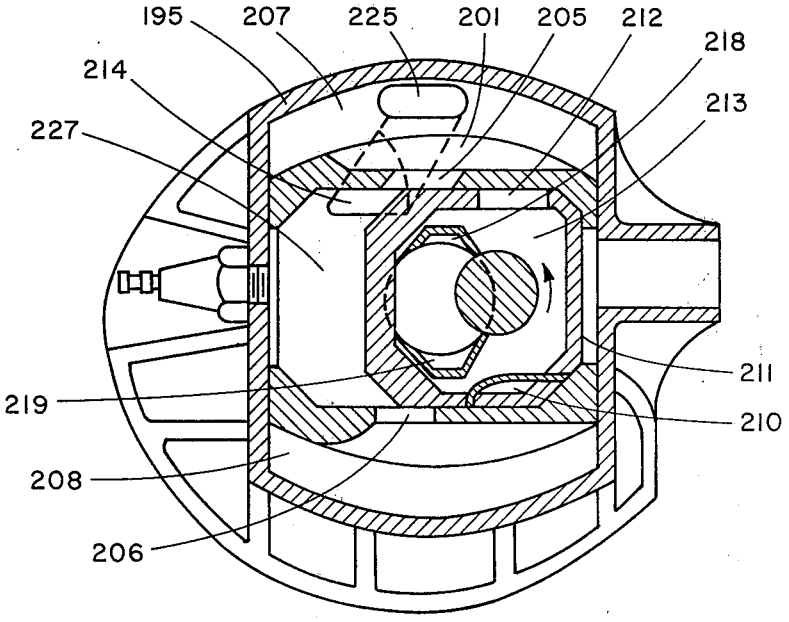
FIG. 50 is a cross sectional view of the embodiment of the engine of FIG. 48 showing the orbiting piston at bottom dead center.
Figure 52:
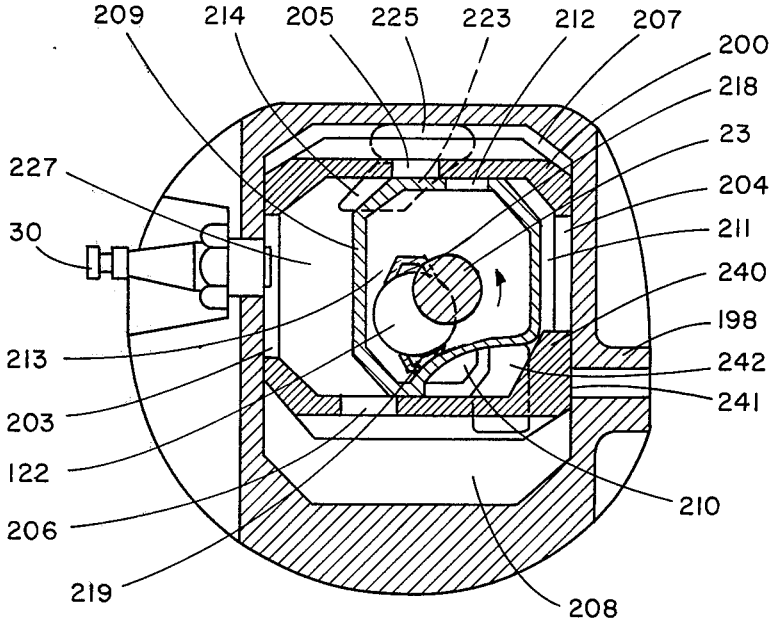
FIGS. 52 and 53 are cross sectional views of yet another embodiment of the engine incorporating a single set of combustion and expansion chambers and incorporating suction and pumping chambers.
Figure 53:
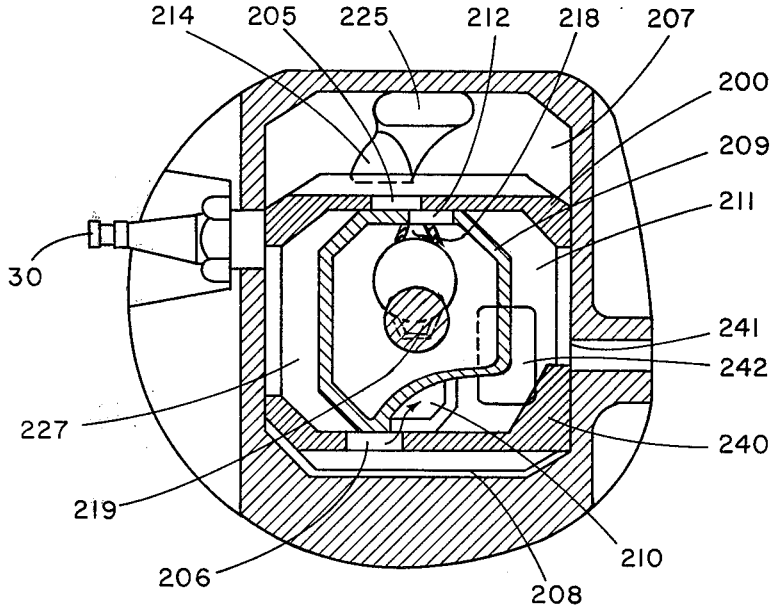

Finally, a modification of the embodiment of FIGS. 48–51 is illustrated in FIGS. 52 and 53 in which like elements are identified by the same reference numerals as in FIGS. 48–50. It will be seen that the exhaust pipe 198 is located off center with respect to chamber 211 serving as a suction chamber, and that moving combustion chamber member 200 has an extension 240 so sized and positioned that as it is moved upwardly, it closes off port 241 in exhaust pipe 198 and hence prevents fluid communication between chamber 211 and the atmosphere. Side ports 242 cut in the forward and after engine blocks and corresponding to ports 185 and 186 of FIG. 47 communicate with port 210 in the orbiting piston to provide fluid communication through port 210 between secondary expansion chamber 208 and suction chamber 211.

In the operation of the modification of FIGS. 52 and 53, ports 206 and 210 permit fluid flow from expansion chamber 208 into chamber 211 when chamber 208 is about onehalf maximum volume and chamber 211 is near zero volume. While expansion chamber 208 increases in volume it begins to pull exhaust gases directly from primary combustion/expansion chamber 227, and suction chamber 211 also begins to increase in volume to provide a significant increase in the suction capability of chamber 208. When the engine modification of FIGS. 52 and 53 is designed so that the maximum volumes of chambers 227, 208, 211 and 207 are about the same, its performance is essentially equal to that of those engines of FIGS. 10–29 wherein the ratio of maximum volume of the primary combustion/expansion chamber, e.g., 110 to that of the secondary expansion chamber, e.g., 112 (FIG. 26) is preferably at least 1 to 1.5.

Generally, it can be said that the ratio of maximum volume of the primary combustion/expansion chamber to maximum volume of the secondary expansion chamber for the engine of this invention should range between about 1 to 1 to about 1 to 2.

In the modification of FIGS. 52 and 53, chamber 211 may be considered to be a "working" chamber. Exhaust exit port 241 is used to allow forced extraction of the exhaust products to the atmosphere by orbiting piston 209 while chamber 211 is decreasing in volume. At the point chamber 211 has reached minimum volume (when orbiting piston 209 has reached bottom dead center and moving combustion chamber member 200 has reached its center vertical position) port 241 is closed by an extension 240 of the combustion chamber member and chamber 211 is closed off from the atmosphere. As orbiting piston 209 continues moving, working chamber 211 begins to increase in volume and the side ports 242, begin to open to connect chambers 208 and 211. As illustrated in FIG. 53, as chambers 208 and 211 each expand in volume their combined expansion causes a significant increase in the exhaust products pulled from combustion chamber 227 through port 206. Such combined suction effect causes a still further lowering of pressure in chamber 227 which allows more fuel/ air mixture to enter chamber 227 through port 225 and 214 from the pressure/pumping chamber 207.

During the time that working chamber 211 is increasing in volume, it is pulling the spent exhaust products into it from chamber 208. As soon as orbiting piston 209 has reached top dead center, working chamber 211 has reached maximum volume. Port 241 then begins to open so that a further decrease in volume of chamber 208 causes exhaust products to enter chamber 211 for exhausting into the atmosphere. Side ports (e.g., 242) close at the point suction chamber 211 reaches its maximum volume. As chamber 211 begins to decrease in volume the downward motion of moving combustion chamber member 200 continues to force combustion gases from chamber 208 to chamber 211 through ports 206 and 210. Simultaneously, motion of orbiting piston 209 forces the spent exhaust products out through port 241 until chamber 211 has reached its minimum volume point. Then port 241 closes and the side ports begin to open to allow chamber 211 to again begin its suction function.

This modification of the engine of this invention thus utilizes all four chambers as functional chambers. Chamber 227 functions as a compression and power chamber; chamber 208 functions as a dual-expansion, suction and first exhaust extraction chamber; chamber 211 functions as a second suction and exhaust extraction chamber; and chamber 207 functions as a fuel/air inlet and pressurized fuel/air pumping chamber to provide a pressurized fuel/air mixture to combustion chamber 227.

The engine of this invention is particularly suited to several unique and advantageous modifications including porting design and operation, vectorial force balancing and the use of glow plugs as ignition means. An example of porting modification is shown in FIGS. 54–58, of vectorial force balancing in FIGS. 59–63, and of glow plug use and timing control in FIGS. 64–66.

Because in the engine of this invention the fuel/air mixture is pulled into the primary combustion/expansion chamber along a relatively long rectangular-shaped path in one direction, it is not subject to any appreciable further mixing prior to ignition. Hence the fuel/air mixture flow along the slim profile of the primary combustion chamber cavity progresses as a near laminar flow process. It continues until it reaches a point when flow stops and compression of the flow line begins. This is of course, in direct contrast to the operation of a typical four-stroke piston engine, which undergoes random mixing of all the fuel/air products due to the open nature of the combustion chamber as well as to the fact that the induction stroke occurs prior to a change in direction of the piston.

Figure 54:
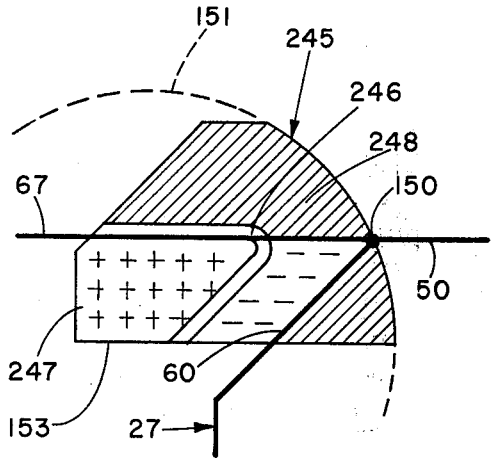
FIGS. 54–56 illustrate somewhat diagrammatically the use of a modified porting system to accomplish stratified charging of the fuel/air mixture into the combustion chamber.
Figure 55:
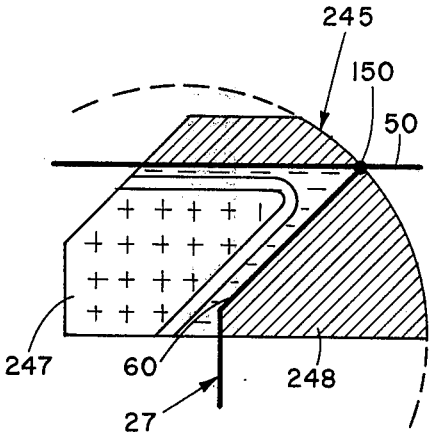
Figure 56:
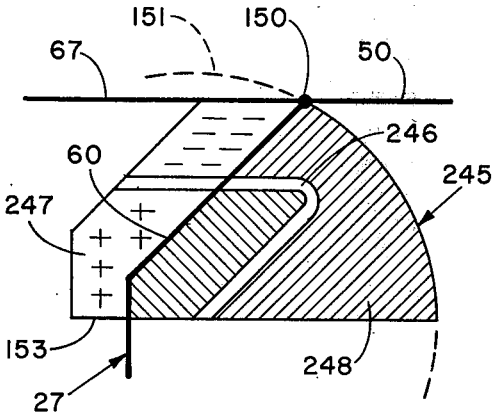

The unique porting and operation of the orbiting piston within the moving combustion chamber member means that when compression begins the location within the primary combustion chamber of any one line of fuel/air mixture can be directly related to the time when that line entered the chamber from the induction port. Thus by providing a means for controlling the fuel-to-air ratio of the fuel/air mixture entering the combustion chamber, it is possible, in conjunction with the induction porting means, to establish a pattern of rich and lean mixtures within the primary combustion chamber prior to ignition. For example, if the port is able to provide a slightly rich mixture one-half way through the port opening, this rich portion of the fuel-/air mixture can be located essentially in the center of the flow line during compression. If the spark plug is also located in the center and adjacent to this rich region at the instant the spark is initiated, this rich region will ignite. This will in turn ignite an overall lean mixture in the remaining portion of the combustion chamber. FIGS. 54–56 illustrate exemplary porting means for accomplishing this. In these figures the same reference numerals are used as were used in FIGS. 30–32 since the opening and closing of the modified port 245 is effected by opening edge 67 of the moving combustion chamber member and by the closing edge 60 of orbiting piston 27. Port 245 is divided by means of a separator member 246 into two subports 247 and 248, each of which is connected to a separate carburetor (not shown). As in FIGS. 30–31, those portions of subports 247 and 248 which are not open are lightly cross hatched; while that portion of subpoint 247 which is open to the carburetor delivering the richer mixture is indicated by a series of +'s and that portion of subport 248 open to the carburetor delivering the lesser mixture is indicated by a series of −'s.

Figure 57:
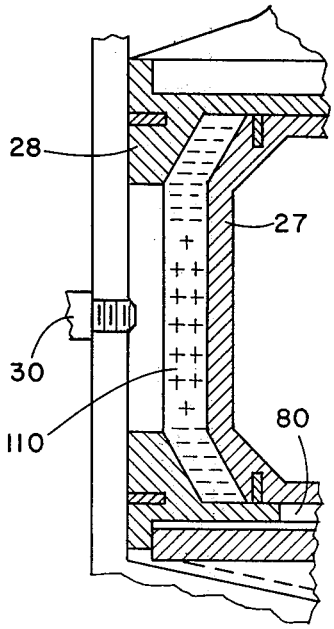
FIG. 57 is a partial cross section through the engine block illustrating the use of the porting system of FIGS. 54–56.

As port 245 is progressively opened and closed, the rich subport area 247 and the lean subport area 248 have varying relative sizes. As shown in FIG. 54, during the early opening of port 245 the rich subport is approximately equal to the lean subport area. As port 245 opens to its maximum port area (FIG. 55) the rich subport area is much larger than the lean subport area. Finally, as port 245 nears its closed position, the two subport areas are again nearly equal. With the proper adjustment of the carburetors it is possible to provide leaner mixtures at the beginning and ending of the port opening time and a slightly richer mixture midway during the time the port is open. Thus, the fuel/air mixture flows into the primary combustion chamber 110 to form a compressed flow line with a rich center and slightly lean mixtures in the areas surrounding this richer region as illustrated in FIG. 57 which corresponds to a point between FIGS. 41 and 34 (just prior to ignition) in the cycle sequence.

Figure 58:
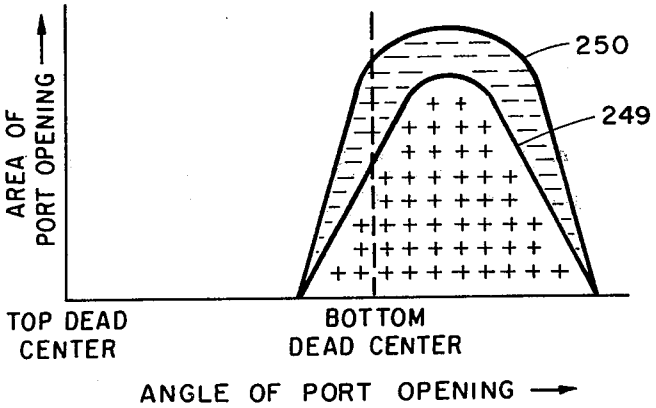
FIG. 58 is a plot illustrating how the changing of the port area with the angle of port opening can be used to attain stratified charging.

FIG. 58 is a diagram in which the angle of port opening is plotted against the area of the opened port for any specific crankshaft angle. This diagram illustrates how the subport size ratios change as the port opening angle changes for the rich and lean subports of FIGS. 54–56. The area of the subport 247 delivering the richer mixture is enclosed under the lower curve 249; and the area enclosed between curves 249 and 250 represents the area of subport 248 connected to the carburetor delivering the leaner mixture. In the timing sequence illustrated in FIG. 58 a 50/50 area ratio occurs for about the first and last 20° of port opening to give a slightly lean mixture; while from about 20° after opening to about 20° before closing, the mixture becomes increasingly richer up to the center of the port opening angle at 30° beyond bottom dead center and then decreases again in richness. Thus through the porting system there is provided means for establishing a predetermined pattern of leaner and richer fuel/air mixtures within the primary combustion chamber just prior to ignition.

In another modification of the engine of this invention balancing means are added to obtain a vectorial balance of all of the inertial forces generated from the moving components. Such means comprises four counterweights supplementing the main crankshaft counterweight as illustrated in FIGS. 59 and 60. It will be recognized that the engine shown in these figures corresponds to that shown in FIG. 26 and that the same reference numerals are used to identify identical components in FIG. 26. However, not all of these components are numbered since their functions are identical to those previously described and do not enter into the balancing of forces in the engine.

In FIGS. 59 and 60 the main crankshaft counterweights 132 (forward) and 133 (after) are shown to be affixed to or integral with respective gears 255 and 256 which are of an annular configuration. There are then provided upper and lower forward counterweights 257 and 258 affixed to or integral with respective gears 259 and 260 which are of the same size and configuration as gear 255. Upper counterweight 257 and associated gear 259 are mounted on a shaft 261 which is supported, through bushings 262 and 263, by the forward engine plate 264 and after engine plate 265 and which passes through the central power block of the engine. In like manner lower counterweight 258 and its associated gear 260 are mounted on shaft 266 running in bushings 267 and 268. Comparable upper and lower after counterweights 269 and 270, affixed to or integral with annularly configured gears 271 and 272 are mounted on shafts 261 and 266, respectively. Ports 273 and 274 are provided for connecting the carburetors (not shown) with the fuel/air induction ports cut to the required size and configuration within after engine plate 265. A suitable housing 275 is provided around the engine assembly.

Supplemental counterweights similar to those shown in FIGS. 59 and 60 may also, of course be added to the other embodiments of the engine of this invention such as those shown in FIGS. 43, 48 and 52.

Supplemental counterweights 257, 258, 269 and 270 must rotate in a direction opposite to that of main crankshaft counterweights 132 and 133 but in the same direction relative to each other. The supplemental counterweights must each complete one revolution for each revolution of the engine crankshaft and this is conveniently done by using one-to-one gear ratios. It is also necessary that the centrifugal force generated by each supplemental counterweight (e.g., counterweights 257 and 258) by exactly one-half the centrifugal force generated by its associated main crankshaft counterweight (e.g., counterweight 132). Finally, it is required that each supplemental counterweight is phased so that its direction of generated centrifugal force is exactly in line and in the same direction as that of the main crankshaft counterweight when the moving combustion chamber member is in either of its maximum vertical positions. This phasing allows the supplemental counterweights to exert their combined centrifugal force in a horizontal direction 180° from the main crankshaft counterweight centrifugal force direction when the moving combustion chamber member is passing through its midway position.

The attainment of essentially complete balancing of the engine is illustrated diagrammatically in FIGS. 61–63. These figures correspond to the positions of the orbiting piston and moving combustion chamber member shown in FIGS. 39, 40 and 33, respectively. In constructing FIGS. 61–63, it is assumed that all of the counterweights and engine components are brought together in the axial direction of the engine crankshaft into a single, two-dimensional plane. This plane passes through the center of the engine with all of the component force lines being shown in the plane perpendicular to the crankshaft axis. Thus in FIGS. 61–63, the main crankshaft counterweights 132 and 133 are represented as counterweight segment 280; upper supplemental counterweights 257 and 269 as counterweight segment 281; and lower supplemental counterweights 258 and 270 as counterweight segment 282.

To understand the function of the supplemental counterweights, it is necessary first to examine the forces within the engine. The moving combustion chamber member is normally balanced by using a main crankshaft counterweight segment 280 which has a rotational centrifugal force equal to one-half the maximum force generated by the moving combustion chamber member. This solution, which is something of a compromise, means that the moving combustion chamber member will exhibit a maximum force at its extreme positions equal to twice the opposing centrifugal force available from the main crankshaft counterweights. Then as the combustion chamber member passes through its midway position (e.g., FIG. 40) its velocity is constant and its acceleration force or inertia is zero. At this point, however, the main crankshaft counterweight segment is generating a centrifugal force equal to one-half the outward unbalanced force of the moving combustion chamber member at its maximum vertical positions (as the engine orientation is illustrated in the drawings). Therefore, any shaking forces on the engine are due to simple harmonic motion of the combustion chamber member and the left-to-right motion of the counterweight. With the addition of the four supplemental counterweights geared to the main crankshaft, the vertical and horizontal shaking forces can be essentially eliminated.

Since the orbiting piston travels in a circular path at a constant angular velocity the counterweight 132 and 133 on the main crankshaft, acting in a direction opposite to the orbiting piston, are used to completely balance the centrifugal force of the orbiting piston. Therefore these force components are excluded from the discussion of FIGS. 61–63. With the elimination of the centrifugal forces generated by the orbiting piston, it follows then that the role of the supplemental counterweight segments 281 and 282 is to provide the other half of the centrifugal force required to fully balance the moving combustion chamber member.

Figure 39:
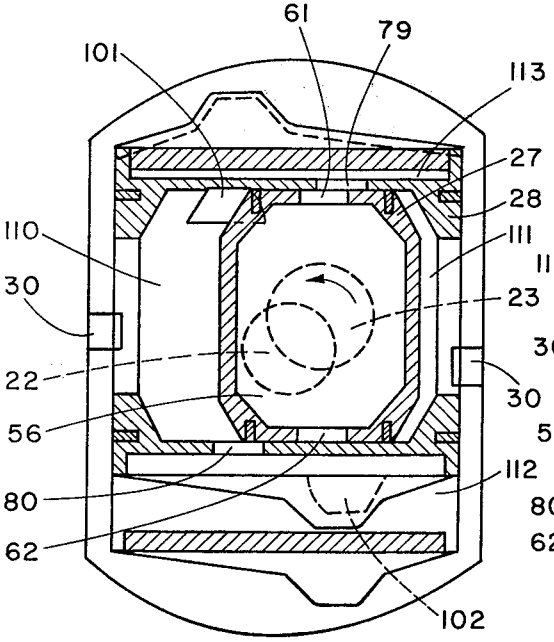

FIG. 61, corresponding to FIG. 39, shows that the centrifugal force action from the main crankshaft counterweight segment 280 is rotated 45° left of vertically down while the centrifugal force action of the supplemental counterweight segments 281 and 282 is rotated 45° right of vertically down. The effect of the force of the moving combustion chamber member on the crankshaft is in a vertically upward direction and acts through the orbiting piston. Since the counterweight segments are acting symmetrically at an angle of 45° from the vertically down position, the vertically down vectorial force resultant is equal to CF 280 cos $\theta$+CF 281 cos $\theta$+CF 282 cos $\theta$. If, for example, the centrifugal force of segment 280 is one pound and the centrifugal force of segments 281 and 282 is each 0.5 pound, then the vertical downward resultant force of the three counterweight segments will equal 1.414 pounds. As shown in FIG. 61, the centrifugal force of the moving combustion chamber member (MCCM) is vertically up, acting through the orbiting piston, crankshaft and crankshaft bearings.

Since the moving combustion chamber member is located at an angle of 45° from the vertical upward position, its upward force action on the engine frame at 45° will be its maximum upward inertial force×cos 45°. Since this inertial force is equal to the combined centrifugal force of the counterweight segments 280, 281 and 282, its upward vertical component at an angle of 45° from vertical would be 2 pounds×cos 45° or 1.414. Thus, the upward vertical centrifugal force on the engine frame caused by the moving combustion chamber member is exactly offset by the combined downward centrifugal force effect of the three counterweight segments at a crankshaft angle of 45° from dead center position of the moving combustion chamber member.

In the position illustrated in FIG. 62, corresponding to FIG. 40, the combined centrifugal forces of counterweight segments 280, 281 and 282 all act downwardly to balance the upward inertial force component of the moving combustion chamber member. In the position illustrated in FIG. 63, corresponding to FIG. 33, the combined centrifugal force of supplemental counterweight segments 281 and 282 balance the centrifugal force of counterweight segment 280 opposed thereto. The moving combustion chamber member in this midway position exerts no inertial force and therefore the counterweight segments must balance each other. It will therefore be seen that the supplementary counterweights geared to the crankshaft in the manner described achieve the complete balancing of the engine.

Figure 34:
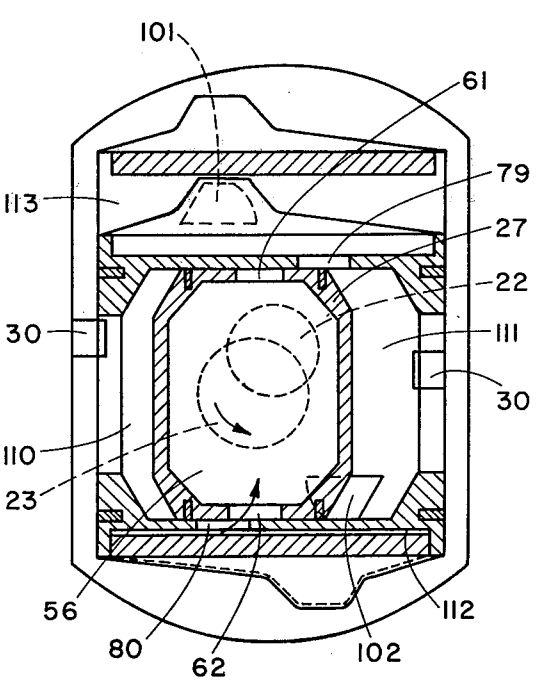

In the engine of this invention vertical motion of the moving combustion chamber member and back and forth motion of the orbiting piston within this member result in the providing of a primary combustion/expansion chamber which in itself moves up and down as the fuel/air mixture is compressed and ignited and the combustion gases expanded. This movement of the primary combustion/expansion chamber offers the unique possibility of incorporating means to control the exposure of a suitable igniting means to the fuel/air mixture to achieve precisely timed ignition by a spark plug or glow plug. The operation of one embodiment of such exposure control means is illustrated in FIGS. 64–66, which show the positions of orbiting piston 27 and moving combustion chamber member 28 at the beginning of ignition, at the end of ignition and near bottom dead center for the combustion chamber member (FIG. 34). Like reference numerals are used to identify like engine components depicted in FIGS. 10–29.

In the embodiment of FIGS. 64–66 the exposure control means comprises the side member or members 71 of the moving combustion chamber member (see FIGS. 18 and 19) which provide a means to cover over the igniting means 290, e.g., a spark plug or glow plug. Thus, in effect, the elongated opening 77, and 78 if used, (FIGS. 19 and 20) is constricted so that side member 291 defines an opening 292 which is of a length to permit the hot tip of glow plug 291 to be exposed to the combustion mixture in chamber 110 from the beginning of ignition until the end of ignition until the end of ignition. With the further downward motion of combustion chamber member 28, the glow plug is closed off from chamber 110. In the engine embodiment wherein opposed primary and secondary chambers are used, e.g., the embodiment of FIGS. 10–29, the combination of the location of the ignition means and position and length of opening 292 will also be used.

As shown in FIG. 64, which represents the point of ignition, the incorporation of the exposure control means allows the compressed fuel/air mixture to be ignited at the optimum angle of the crankshaft, i.e., between about 10° and 35° before orbiting piston 27 reaches top dead center. Moreover, by proper choice of the length of opening 292 it is possible to continue the exposure of the fuel/air mixture in chamber 110 as long as desired to assure the achievement of total ignition. A primary advantage of the use of ignition exposure control means is that it makes it possible to run the engine on inexpensive hydrocarbon fuels using a glow plug. This, in turn, makes it possible to construct small, lightweight engines for such uses as model airplanes, handheld tools and the like. It also makes it possible to make engines of any size without cams, points, coils, wiring and the like which are required for spark ignition or for the use of the expensive glow plug fuels ordinarily required when glow plugs are used.

It is apparent from the foregoing detailed description of the cycle and apparatus of this invention that there is provided a novel and unique internal combustion engine possessing a number of important advantages. Among such advantages are relatively high fuel efficiency, essentially noiseless and vibrationless operation, a major reduction in exhaust temperature, and the ability to achieve the equivalent performance of a four-stroke internal combustion piston engine using simple valving means which reduce the cost of manufacture. Although the engines of this invention are particularly suited to handheld tools because of their relatively noiseless and cool operation, they may, of course, be used for many applications in a wide range of sizes.

It will thus be seen that the objects set forth above, among those made apparent from the preceding description, are efficiently attained and, since certain changes may be made in carrying out the above method and in the constructions set forth without departing from the scope of the invention, it is intended that all matter contained in the above description or shown in the accompanying drawings shall be interpreted as illustrative and not in a limiting sense.

I claim:

1. A method of developing power mechanically through the combustion of a combustible fluid, comprising the steps of (a) providing a source of a combustible fluid;

(b) providing a primary combustion/expansion chamber of controllable variable volume and a secondary expansion chamber of controllable variable volume in controllable fluid communication with said primary chamber;

(c) compressing within said primary chamber a predetermined amount of said combustible fluid by reducing the volume thereof to a minimum and igniting said combustible fluid as said volume approaches said minimum, and simultaneously forcing combustion gases to exhaust from said secondary chamber by reducing the volume thereof while maintaining said primary and secondary chambers isolated from each other;

(d) increasing the volume of said primary chamber to provide combustion gases under pressure and simultaneously reducing the volume of said secondary chamber to its minimum while said chambers remain isolated from each other;

(e) preliminarily expanding said combustion gases in said primary chamber by increasing its volume;

(f) continuing expanding said combustion gases in said primary chamber and increasing its volume, and simultaneously transferring said combustion gases into said secondary chamber and increasing its volume whereby there is provided a total expansion volume greater than the maximum volume of said primary chamber to give rise to a fluid pressure within said chambers below ambient pressure;

(g) continuing the transfer of said combustion gases into the secondary chamber so that further volumetric expansion of the sum of the volumes of the primary and secondary chambers causes pressure in said primary and secondary chambers to become subatmospheric pressure, thereby transferring exhaust gases into the secondary chamber while charging the primary chamber with the combustible fluid via suction caused by said subatmospheric pressure;

(h) decreasing the volume of said primary chamber while continuing said transferring of said combustion gases and simultaneously increasing the volume of said secondary chamber, and then closing off the flow of said combustible fluid into said primary chamber;

(i) continuing decreasing the volume of said primary chamber thereby beginning the compressing of said combustible fluid while simultaneously decreasing the volume of said secondary chamber and exhausting said combustion gases therefrom at approximately ambient pressure while maintaining said primary and secondary chambers isolated from each other, thereby providing the conditions required to repeat the cycle of steps (c)–(i); and (j) employing the expansion of said combustion gases to deliver work.

2. A method in accordance with claim 1 wherein the ratio of the maximum volume of said primary combustion/expansion chamber to the maximum volume of said secondary expansion chamber ranges between about 1 to 1 to about 1 to 2.

3. A method in accordance with claim 1 wherein said steps of admitting said combustible fluid into said primary chamber and then closing off the flow of said combustible fluid are performed by the rapid opening and rapid closing of an induction port.

4. A method in accordance with claim 1 wherein said combustible fluid is a fuel/air mixture and including the step of varying the fuel-to-air ratio in said fuel/air mixture during said step of admitting it into said primary chamber thereby to provide a stratified fuel/air mixture for igniting.

5. A method in accordance with claim 1 wherein said step of igniting said combustible fluid comprises controllably exposing said fluid to a heat source.

6. A method in accordance with claim 1 comprising providing two opposing sets of said primary combustion/expansion and secondary expansion chambers and performing steps (c) through (i) in each set, the cycle steps in one set being 180° out of phase with the cycle steps of the other.

7. A method in accordance with claim 1 including the steps of providing a suction chamber in controllable fluid communication with said secondary expansion chamber and having a volume which decreases as the volume of said primary chamber increases, and an exhausting chamber open to the atmosphere in controllable fluid communication with said suction chamber and having a volume which decreases as the volume of said secondary chamber increases; transferring said combustion gases from said secondary chamber to said suction chamber during steps (c), (d), (e), (g), (h) and (i) thereby further reducing the pressure in said primary chamber; and exhausting said combustion gases from said suction chamber into said exhausting chamber during steps (c), (d), (e), (g), (h) and (i).

8. A method in accordance with claim 1 including the steps of providing a condensing chamber in controllable fluid communication with said secondary expansion chamber and having a volume which decreases as the volume of said primary chamber increases, and a pressure/pumping chamber in controllable fluid communication with a source of said combustible fluid and with said primary chamber; transferring said combustion gases from said secondary chamber to said condensing chamber during steps (c), (d), (e) and (i); and transferring said combustible fluid into said pressure/pumping chamber from said source during steps (c), (d), (e) and (i) and then pumping said combustion fluid from said pressure/pumping chamber into said primary chamber during steps (g) and (h) thereby to effect a push-pull action on said combustion gases out of said primary and secondary chambers.

* * * * *